United States Patent [19]

Saito et al.

[11] Patent Number: 4,792,825

[45] Date of Patent: Dec. 20, 1988

[54] ROTARY DEVELOPING DEVICE FOR IMAGE-FORMING APPARATUS

[75] Inventors: Takeshi Saito, Tokyo; Hiromitsu Takagaki, Yokohama, both of Japan

[73] Assignee: Ricoh Company, Ltd., Tokyo, Japan

[21] Appl. No.: 98,607

[22] Filed: Sep. 18, 1987

[30] Foreign Application Priority Data

| | | | |
|---|---|---|---|
| Sep. 20, 1986 | [JP] | Japan | 61-223211 |
| Sep. 20, 1986 | [JP] | Japan | 61-223212 |
| Sep. 20, 1986 | [JP] | Japan | 61-223213 |
| Sep. 20, 1986 | [JP] | Japan | 61-144835[U] |
| Sep. 20, 1986 | [JP] | Japan | 61-144840[U] |

[51] Int. Cl.[4] ..... G03G 15/09

[52] U.S. Cl. ..... 355/300

[58] Field of Search ..... 355/3 R, 4, 300, 140; 118/652, 657, 658, 661; 222/DIG. 1

[56] References Cited

U.S. PATENT DOCUMENTS

| | | | |
|---|---|---|---|
| 4,147,426 | 4/1979 | Miyoshi et al. | 355/300 X |
| 4,271,786 | 6/1981 | Buckley et al. | 355/300 X |
| 4,338,880 | 7/1982 | Tabuchi et al. | 355/300 X |
| 4,622,916 | 11/1986 | Tanaka et al. | 355/4 X |

*Primary Examiner*—Donald A. Griffin

*Attorney, Agent, or Firm*—Oblon, Fisher, Spivak, McClelland, & Maier

[57] ABSTRACT

A rotary developing device installed in a copier, printer and other image-forming apparatuses for developing a latent image which is electrostatically formed on an image carrier. A developing unit has at least one developing section therein and is rotatably supported at a predetermined position where it faces the image carrier. The developing unit is removably mounted on a unit carrier which is in turn slidably supported by a body of the image-forming apparatus. At least one of opposite end walls which define opposite ends of a developer chamber of the developing section is provided with cylindrical outer periphery and supported by support members at at least two points of the cylindrical outer periphery. At least one of the support members is held by a movable member which is mounted on the unit carrier. A means is provided for moving the support member away from the developing unit and, when the developing unit is loaded in the predetermined position, moving it into abutment against the end wall of the developing unit.

5 Claims, 19 Drawing Sheets

I
8
114B
14
19R
26
90
114R
78
19
14R
26R
19B
114
26B
14B
O
94
75
J
88
72
91
71
63
69
86
71a
117
116
I
95
66
73
89
68
67
115
65
62

ROTARY DEVELOPING DEVICE FOR IMAGE-FORMING APPARATUS

BACKGROUND OF THE INVENTION

The present invention relates to a developing device installed in a copier, printer and other image-forming apparatuses for developing a latent image which is electrostatically formed on an image carrier. More particularly, the present invention is concerned with a rotary developing device of the type having a developing unit which has at least one developing section with a developing chamber therein and is rotatably supported in a predetermined position where it faces the image carrier, and a unit support slidably supported by a body of the image-forming apparatus and by which the developing unit is removably supported.

A developing device of the type described is known in the art in relation to a color electrophotographic copier, color printer and other color image-forming apparatuses. As regards such a developing apparatus, various problems have heretofore been left unsolved, as enumerated below.

(1) In this kind of developing device, developing sections of a developing unit which are each adapted to develop a latent image by a developer are selectively brought to a predetermined developing station and, hence, the developing unit itself has to be rotatably supported. To meet this need, it has been customary to provide shafts each of which extends from the center of a respective one of opposite end walls that define opposite ends of developer chambers of the developing sections, the shafts each being individually rotatably supported by a bearing. However, in the case that a developing device or various elements of other devices are arranged outside of the developing unit, the above scheme becomes impracticable because a space for accommodating the bearings is unavailable. For example, when toner supply devices are located outward of the end wall of the developing unit, a plurality of toner supply conduits would extend outward from the end wall to occupy the space which should be allotted to the bearings.

(2) At least one of opposite end walls which delimite developer chambers of a developing unit may be provided with a cylindrical configuration and supported by support pieces at at least three points of the cylindrical outer periphery. This advantageously allows the developing unit to be rotatably supported in a secure condition, even if a developing device or various elements of other devices are located outward of that end wall. Nevertheless, as previously stated, where a unit support which supports the developing unit is manually movable out of a predetermined position in the body of an image-forming apparatus and, yet, the developing unit is removable from the unit support, the three support members supporting the end wall would interfere with the developing unit to prevent the latter from being removed from the unit support.

(3) The above-described type of developing apparatus in which a developing unit can be pulled out from an apparatus body while being held by a unit support facilitates the adjustment, repair, inspection and others of the unit. Usually, various sections of the developing unit, even the bottom and the back thereof, need such work. Especially, in a rotary developing device of the type having a developing unit which is rotatably mounted in an image-forming apparatus, the unit has to be inspected over its entire circumference. However, because this type of prior art device maintains the developing unit simply unmovably supported on the unit support when the unit is pulled out of the apparatus body, the bottom and the back of the unit are not accessible unless the unit is bodily removed from the unit support and, then, turned over. This not only limits the efficiency attainable but also causes the person's hands and clothes to be stained by the developer. Especially, turning over a developing unit having a plurality of developing sections or a developing unit for use with an apparatus for forming large-sized images is extremely awkward since such a device is large and heavy.

(4) In a developing device of the type described, when a developing unit supported on a unit support is inserted into the body of an image-forming apparatus until it reaches a predetermined position relative to an image carrier, a developing roller, developing belt or like developer transport member of the unit faces the image carrier with or without a narrow gap defined therebetween. Hence, if the developing unit, i.e., unit carrier is pulled out of the apparatus body, there is a fear that the developer transport member or any other structural member of the unit interferes with the image carrier to scratch its surface. Also, it may occur that the image carrier shaves the developer off the developer transport member due to its contact with the latter, the developer contaminating the neighborhood of the developing device. To cope with this problem, an implementation has been proposed which allows the developing unit to be moved away from the image carrier when the unit is to be moved into and out of the apparatus body. However, the implementation proposed is complicated in structure and expensive. Further, the developing unit is usually located in a predetermined position within the apparatus body by locating the axis of the developer transport member relative to the apparatus body. However, in a rotary developing device in which the developing unit has to be rotated, should a developer transport member remote from the center of rotation of the unit be located relative to the apparatus body, the developing unit would become unrotatable. For this reasons, such a prior art construction has been impracticable with a rotary developing device.

SUMMARY OF THE INVENTION

It is, therefore, an object of the present invention to provide a rotary developing device for an image-forming apparatus which is free from the drawbacks discussed above.

It is another object of the present invention to provide a rotary developing device for an image-forming apparatus which allows a developing unit to be rotatably supported in a secure condition, even if various elements are arranged outward of opposite end walls of the unit.

It is another object of the present invention to provide a rotary developing device for an image-forming apparatus which allows a developing unit to be removed without any obstruction from a unit support when the unit is pulled out from the image-forming apparatus.

It is another object of the present invention to provide a rotary developing device for an image-forming apparatus which facilitates maintenance, inspection and others of a developing unit which is pulled out from the image-forming apparatus and mounted on a unit support.

It is another object of the present invention to provide a rotary developing device for an image-forming apparatus which minimizes the increase in cost.

It is another object of the present invention to provide a generally improved rotary developing device for an image-forming apparatus.

A rotary developing device for an image-forming apparatus of the present invention comprises a developing unit having at least a developing section for developing an electrostatic latent image formed on an image carrier which is supported by a body of the image-forming apparatus, and a unit carrier for supporting the developing unit and slidably supported by the body. When the developing unit is pulled out together with the unit carrier from a predetermined position which is defined in the apparatus body, the developing unit remains rotatably supported by the unit carrier.

The above and other objects, features and advantages of the present invention will become more apparent from the following detailed description taken with the accompanying drawings.

DESCRIPTION OF THE PREFERRED EMBODIMENTS

Figure 1:
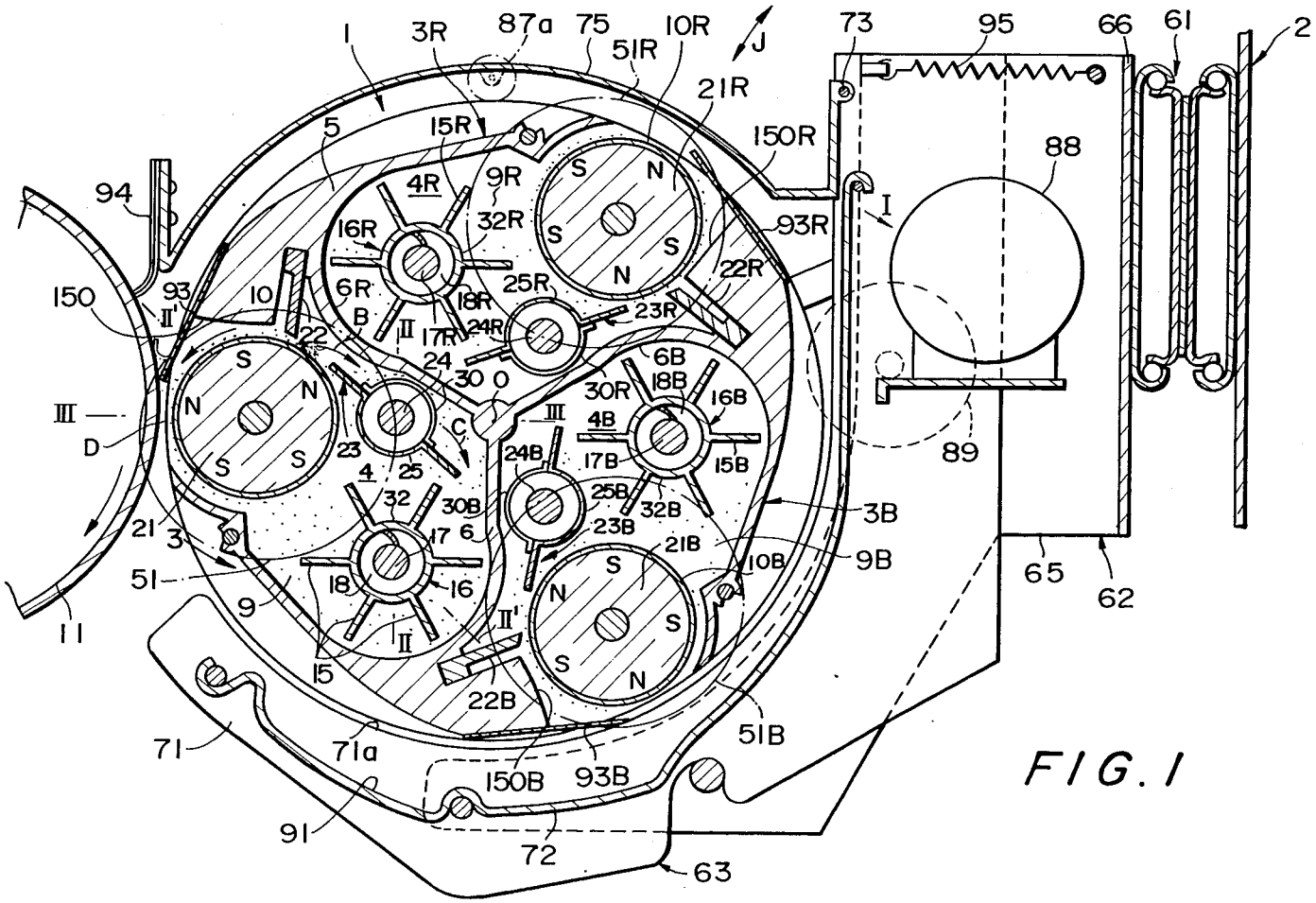
FIG. 1 is a vertical section of a developing device embodying the present invention, a developing unit being shown loaded in a copier body.

Referring to FIG. 1 of the drawings, a rotary developing device embodying the present invention is shown. As shown, the developing device includes a developing unit 1 which is detachably mounted in a copier body 2, as described in detail later. While the developing unit 1 is shown loaded in a predetermined position in the copier body, it is shown unloaded from the same in FIG. 4. The developing unit 1 is provided with at least one, three in this embodiment, developing sections 3, 3R and 3B which are provided integrally with each other. Developing chambers 4, 4R and 4B are defined in, respectively, the developing sections 3, 3R and 3B by three partitions 6, 6R and 6B of a casing member 5 and two end walls 7 and 8 (see FIGS. 2, 3 and 4) which are fixed to opposite ends of the casing member 5. The casing member 5 is made of a non-magnetic material such as aluminum. Developers 9, 9R and 9B are stored in the developing chambers 4, 4R and 4B, respectively. In this particular embodiment, the developers 9, 9R and 9B are assumed to be a black, a red and a blue developer, respectively. If desired, developers with cyan, yellow and magenta toner may be stored one in each of the developing chambers to produce a full-color image. Alternatively, developers of the same color may be stored in all of the developing chambers to selectively use them. While the developers may each comprise a one-component developer which does not contain toner therein, in this particular embodiment, they are each assumed to comprise a two-component developer which contains carrier and toner therein, and at least a part of it is magnetic. While the developing sections 3, 3R and 3B are arranged radially around the center of rotation O of the developing unit 1, they are constructed in exactly the same manner as each other and, therefore, the following description will concentrate mainly on the developing section 3 by way of example. As for the other developing sections 3R and 3B, the structural elements will be designated by the same reference numerals as those of the developing section 3 except for suffixes "B" and "R". This is also true with toner supply devices which are associated one with each of the developing sections 3, 3R and 3B, as described in detail later.

As will be described later, the developing device unit 1 is supported to be rotatable about the center of rotation O, so that the developing sections 3, 3R and 3B (more precisely, their developing rollers) may be sequentially brought to a predetermined developing station D. In the particular condition shown in FIG. 1, the developing section 3 is located at the developing station D. The reference numeral 88 designates a drive motor for driving the developing unit 1 about the center O. In FIG. 1, a developer conveying member, or developing roller, 10 associated with the developing section 3 is partly exposed to the outside through an opening which is defined by the partitions 6 and 6R (see FIG. 4 also). The developing roller 10 in the developing station D assumes a predetermined position relative to an image carrier 11 which is rotatably supported by the printer body 2. While the image carrier 11 is shown as comprising a photoconductive drum, it may be replaced with a conductive belt or, depending upon the type of an image-forming apparatus, a dielectric image carrier in a form of drum or belt, as well known in the art. The developing roller 10 is located in parallel to the drum 11 with a predetermined small gap defined therebetween. As shown in FIG. 3, shafts 12 and 13 extending away from each other from opposite ends of the developing roller 10 are journalled to, respectively, opposite end walls 7 and 8 of the developing unit 1. The inner shaft 13 with respect to an intended direction of mounting and dismounting the developing unit 1 (left-hand side as viewed in FIGS. 2 and 3) extends throughout the end wall 8 and is provided with a gear 14 at its extreme end.

A bladed wheel 16 having a number of blades 15 is disposed in the developer chamber 4. The bladed wheel 16 is integrally mounted on a transport screw shaft 17 which is disposed in a boss portion 32 of the wheel 16 to extend parallel to the developing roller 10. In this configuration, as the screw shaft 17 is rotated, the bladed wheel 16 is rotated counterclockwise as viewed in FIG. 1. When rotated so, the bladed wheel 16 feeds the developer, i.e., toner and carrier from the developer chamber 4 to the developing roller 10 while agitating it. The agitation by the blades 15 causes the toner to be frictionally charged to a predetermined polarity.

Figure 2:
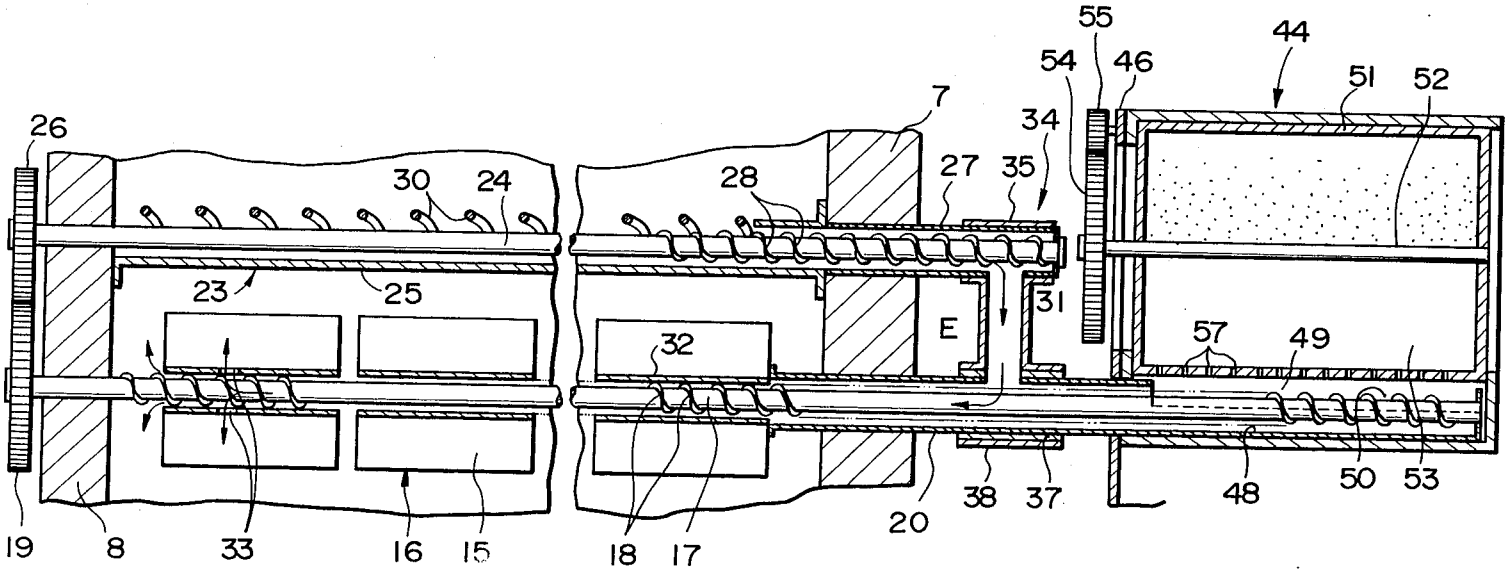
FIG. 2 is a section along line II—II of FIG. 1 and, as regards a toner supply device, showing it in a section along line II'—II'.
Figure 3A:
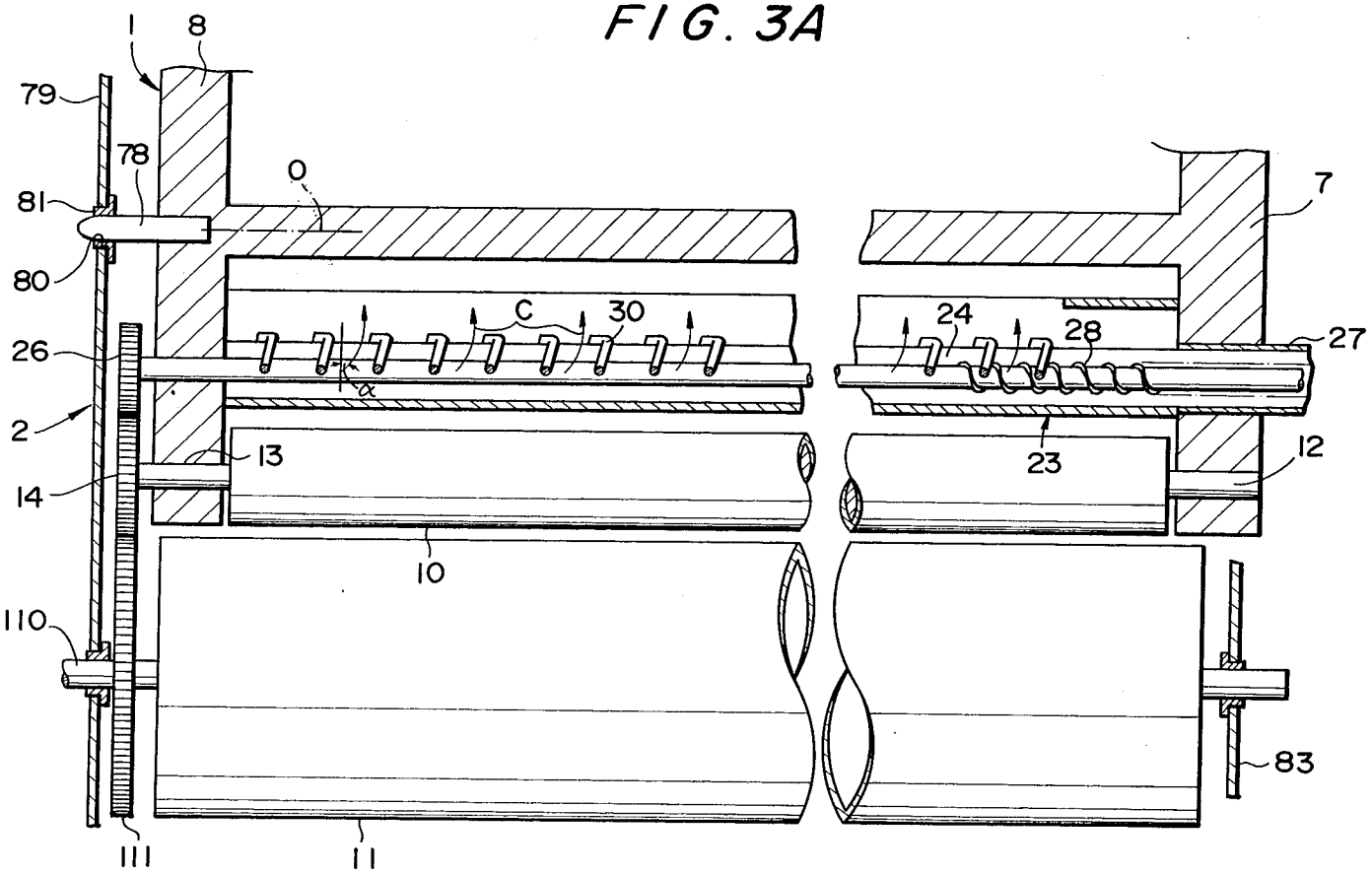
FIG. 3A is a section along line III—III of FIG. 1.

The inner end of the transport screw shaft 17 which is located at the left-hand side as viewed in FIG. 2 rotatably extends throughout the end wall 8 of the printer body 2, a gear 19 being rigidly mounted on that end of the screw shaft 17. In this construction, the screw shaft 17 is rotated together with the bladed wheel through the gear 19. The other end, or outer end as distinguished from the inner end, of the screw shaft 17 extends in the interior of a toner supply conduit 20 which is rigidly received in an opening of the end wall of the copier body 2, thereby being rotatably supported by the toner supply conduit 20. In this particular embodiment, the transport screw shaft 17 and the toner supply conduit 20 constitute a developer transport means for supplying the developer to the developer chamber 4.

A magnet 21 having S and N poles as labeled S and N in FIG. 1 is accommodated in the developing roller 10 and fixed to the casing member 5 of the developing unit 1. As the developing roller 10 is rotated counterclockwise as viewed in FIG. 1 through the gear 14, the magnetic developer 9 supplied to the developing roller 10 is retained on the roller surface by the magnetic force of the magnet 21 and conveyed in the counterclockwise direction. A doctor blade 22 is rigidly mounted on the casing member 5 to scrape the developer on the developing roller 10 so as to regulate the thickness of the developer layer, the regulated amount of developer being fed toward the drum 11.

On the other hand, the drum 11 is rotated clockwise as viewed in FIG. 1. Charging and exposing means, not shown, forms a latent image corresponding to a document image electrostatically on the surface of the drum 11 by a procedure which per ce is well known in the art. As the latent image reaches the developing station D at which the drum 11 and the roller 10 face each other, the charged toner in the developer which is also transported to the station D is electrostatically transferred from the roller 10 to the drum 11 to turn the latent image into a visible toner image. Because the developing section 3 is assumed to store black toner, the toner image formed on the drum 11 as stated is also black. The toner image is transferred by a transfer device, not shown, to a paper, not shown and, then, fixed by a fixing device, not shown. The developer moved past the developing station D is returned to the developer chamber 4 to be mixed with the other developer within the chamber 4, the resulting mixture being reused.

The developer scraped off by the doctor blade 22 is conveyed by a guide member 23 in a direction indicated by an arrow B to reach another transport screw shaft 24, which extends parallel to the transport screw shaft 17. While a part of the developer is fed out of the developer chamber 4 by the screw shaft 24 as will be described, the rest of the developer is caused to flow on and along the guide member 23 as indicated by an arrow C in FIG. 3A until it drops on the bladed wheel 16 which is located at the bottom of the chamber 4.

As shown in FIGS. 1 to 3B, the guide member 23 includes a channel portion 25 which covers a substantially lower half of the transport screw shaft 24. The opposite ends of the guide member 23 are individually rigidly connected to the end walls 7 and 8 of the developing unit 1. One end of the screw shaft 24 which is located on the left-hand side as viewed in FIG. 2 is rotatably supported by the inner end wall 8 while extending throughout the end wall 8. A gear 26 is mounted on the extreme end of the screw shaft 24 for driving the screw shaft 24. The other end of the screw shaft 24 which is located at the right-hand side as viewed in FIG. 2 is disposed in and rotatably supported by a tube 27 which is securely received in an opening of the end wall 7. A screw 28 is provided on the screw shaft 24. While the screw 28 may be provided over the entire length of the screw shaft 24, in this embodiment, it is shown as spanning only that portion of the screw shaft 24 which is received in the tube 27 and a portion which extends from the above-mentioned portion toward the developer chamber 4.

Figure 3B:
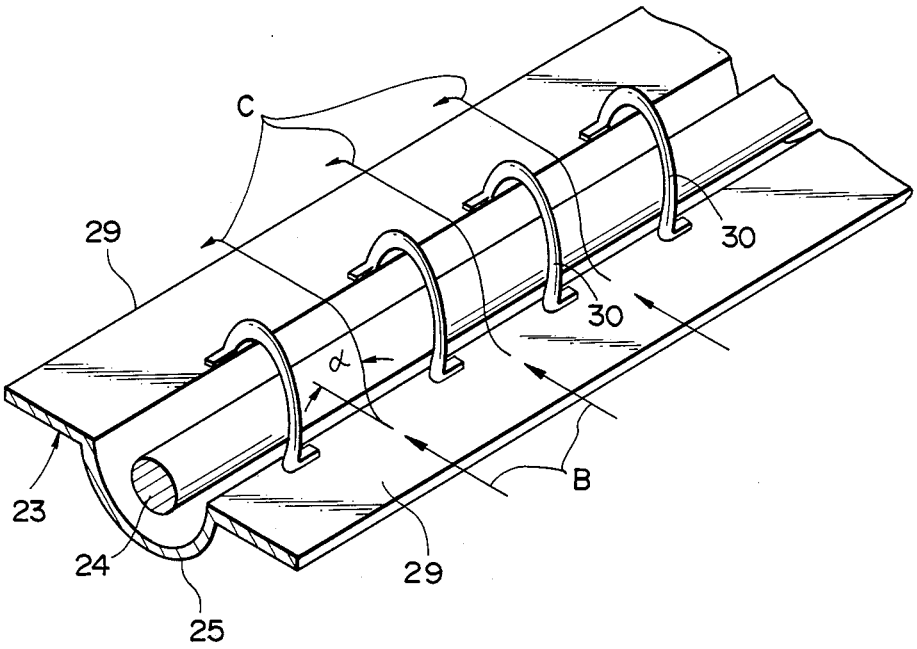
FIG. 3B is a perspective view of a guide member and guide fins associated therewith.

As shown in FIG. 3B, flanges 29 extend outward from the channel portion 25 of the guide member 23. A number of guide fins 30 are rigidly connected to the opposite flanges 29 straddling the transport screw shaft 24. As shown, the guide fins 30 are individually inclined relative to a direction which is perpendicular to the axis of the developing roller 10. In this configuration, the developer scraped off by the doctor blade 22 to flow along the guide member 23 as stated earlier are guided by the guide fins 30 in a direction indicated by an arrow C which is inclined by an angle a, FIGS. 3A and 3B, relative to the direction perpendicular to the axis of the developing roller 10. In this manner, the developer flows along the guide member 25 while being sequentially shifted in a direction perpendicular to the sheet surface of FIG. 1 by the guide fins 30, enhancing effective agitation of carrier and toner.

On the other hand, that part of the developer which flows from the doctor blade 22 to the screw 28 on the transport screw shaft 24 which is driven through the gear 26 in a rotational motion is conveyed by the screw 24 through the channel portion 25 of the guide member 23 and the tube 27 toward the outside of the copier body, until it has been discharged to the outside of the unit end wall 7. The transport screw member 24, the channel portion 25 of the guide member 23, and the tube 27 constitute a developer discharging means.

As shown in FIG. 2, the tube 27 and the toner supply conduit 20 are communicated to each other by a connecting tube 31, which will be described in detail later. Hence, the developer propagated through the tube 27 as stated above is admitted into the toner supply conduit 20 by way of the connecting tube 31. Then, it is conveyed to the left as viewed in FIG. 2 by the screw 18 of the transport screw shaft 17 which is being rotated by the gear 19, while being guided through the boss portion 32 of the bladed wheel 16. The developer transported so is discharged into the developer chamber 4 through an opening provided at the innermost end of the bladed wheel 16 as well as through apertures 33 located in the vicinity of that opening. In this manner, the developer fed by the transport screw shaft 24 from the outer region of the developer chamber 4 (rightward region as viewed in FIG. 2) is conveyed by the other transport screw shaft 17 toward the inner region (leftward region as viewed in FIG. 2) to be mixed with the other developer inside of the chamber 4. Such allows the toner and carrier of the developer to be effectively agitated to prevent the image quality from being impaired. Advantageously, the screw shaft 17 is rotated at a higher speed than the screw shaft 24 in order to prevent the developer from clogging the tube 27, the conduit 20 and/or the boss portion 32 of the bladed wheel 16.

Now, as a two-component developer is used over a long time, carrier contained therein is sequentially deteriorated to give rise to the need for replacement of the whole developer. To facilitate such replacement of a developer, this embodiment adopts the following arrangement.

Specifically, as shown in FIGS. 2, 5A, 5B and 6, the connecting member 34 includes a first cylindrical portion 35 which is rigidly mounted on the tube 27. A switching member 36 which constitutes a path selecting means has a sleeve 37 which is coupled over the toner supply conduit 20 in such a manner as to be rotatable as indicated by an arrow F. The connecting member 34 also includes a second cylindrical portion 38 which is unmovably fitted on the sleeve 37. The previously mentioned connecting tube 31 is connected to the cylindrical portions 35 and 38 at opposite ends thereof. A vent tube 39 extends radially outward from the sleeve 37. The second cylindrical portion 38 of the connecting member 34 is provided with a notch 40 so that it may not interfere with the sleeve 37 while the sleeve 37 is rotated in the direction F.

Figure 6:
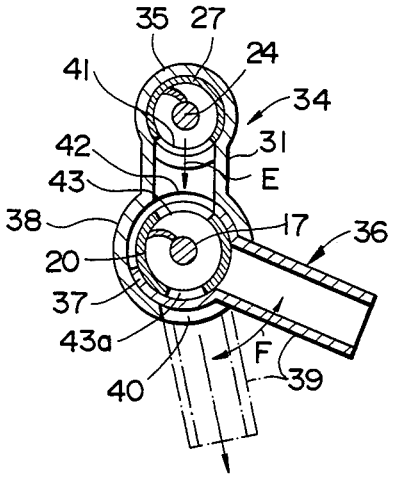
FIG. 6 is a section along line VI—VI of FIG. 5B.

As shown in FIG. 6, the tube 27 and the toner supply conduit 20 are communicated to each other by an opening 41 formed through the tube 27, the connecting tube 31, an opening 42 formed through the sleeve 37, and an opening 43 formed through the conduit 20, so that the developer may be introduced into the conduit 20 from the tube 27 in the previously described manner (arrow E). In a usual condition for development, the vent tube 39 is positioned as represented by a solid line in FIG. 6 and, therefore, stopped by the wall of the tube 27. Hence, the developer transported from the developer chamber 4 to the outside of the developing section 3 and, then, introduced into the toner supply conduit 20 is entirely returned to the chamber 4 through the conduit 20.

As the need for the replacement of developer arises, the sleeve 37 is rotated to position the vent tube 39 as indicated by a dash-and-dot line in FIG. 6 with the developing unit 1 held in the predetermined position inside the copier body 2. Then, an opening 43a formed though the toner supply conduit 20 and the vent tube 39 are brought into alignment with each other. In this condition, when the developer is fed from the tube 27 to the conduit 20 as previously stated, the whole developer will flow to the outside through the vent tube 39 as indicated by a dash-and-dot arrow in FIG. 6. The operator may receive the developer coming out of the vent tube 39 by using a container, not shown. The developer chamber 4 is exhausted in this manner. A fresh developer may be supplied by using a toner supply device which will be described. All that is required after the replacement of developer is returning the switching member 36 to the solid-line position as shown in FIG. 6. In short, the used developer can be discharged simply by rotating the switching member 36 while maintaining the developing unit 1 loaded in the copier body 2. This eliminates the need for removing a developing unit bodily from a copier body and, then, turning it over to replace a developer as in the prior art device.

As described above, in this particular embodiment, the developer feed-out means and the developer feed-in means which are adapted to circulate and agitate a developer are communicated to each other outside of a developer chamber. The path selecting means is operable to determine whether to return the developer conveyed to the outside of the developer chamber to the developer chamber by the feed-in means or to discharge it to the outside of the developing unit. This advantageously implements a construction for agitating the developer and that for discharging the developer at the same time. If desired, however, an exclusive vent port may be formed through the feed-out means outside of the developing section. It should be born in mind that the feed-in or feed-out means and the switching means shown and described are only illustrative and may be replaced with any other arrangements which per ce are well known in the art, insofar as they are capable of transporting a powdery material and switching the transport path therefor.

As the developing operation is repeated, the toner in the developer is sequentially transferred to the drum 11. To compensate for such toner consumption, additional toner has to be replenished to the developer chamber 4. In accordance with one embodiment of the present invention, the above requirement is met by providing the developing unit 1 with a toner supply device 44 as will be described.

Figure 4:
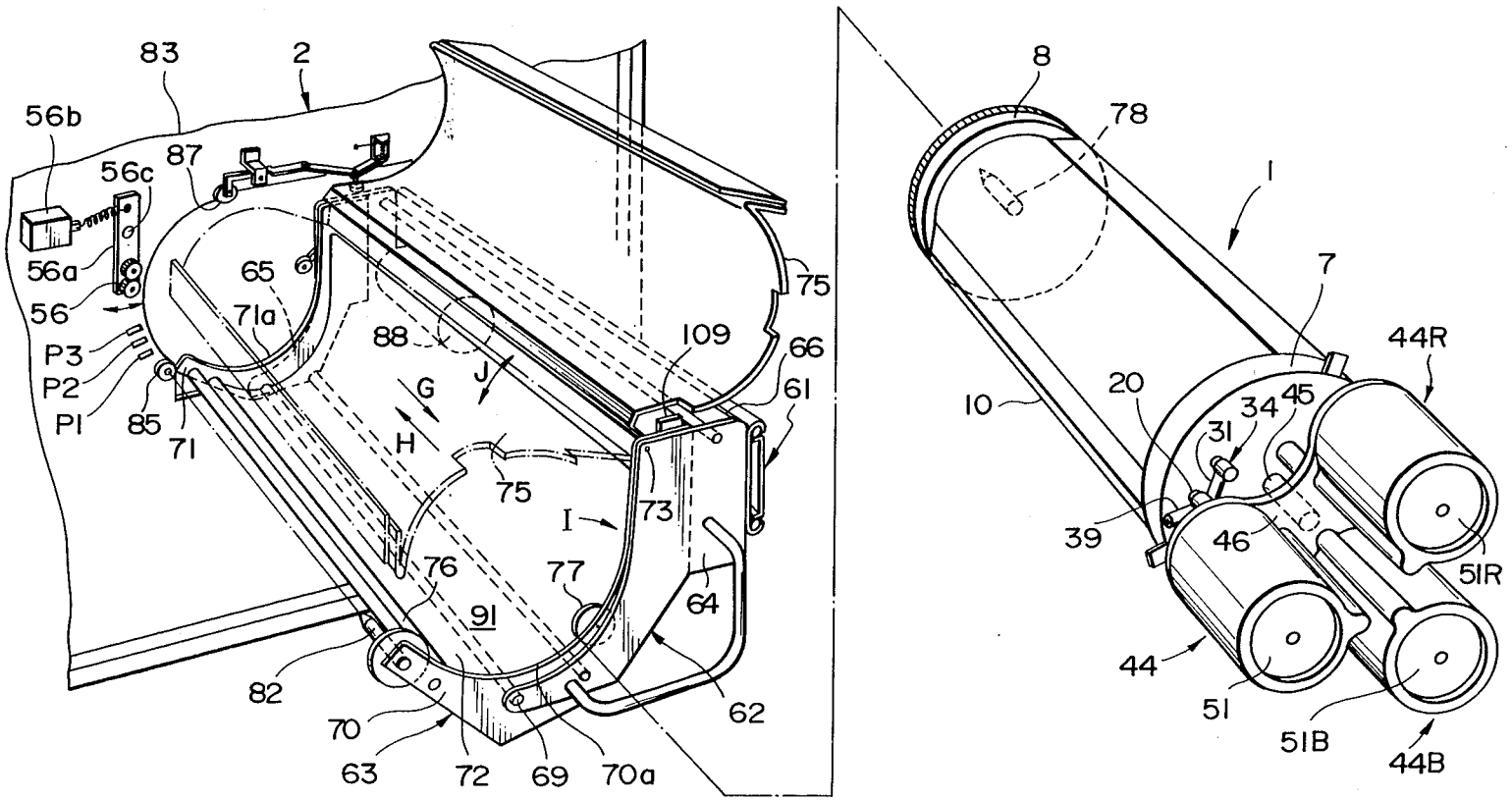
FIG. 4 is a perspective view showing a cradle pulled out from the copier body and the developing unit removed from the cradle.
Figure 5A:
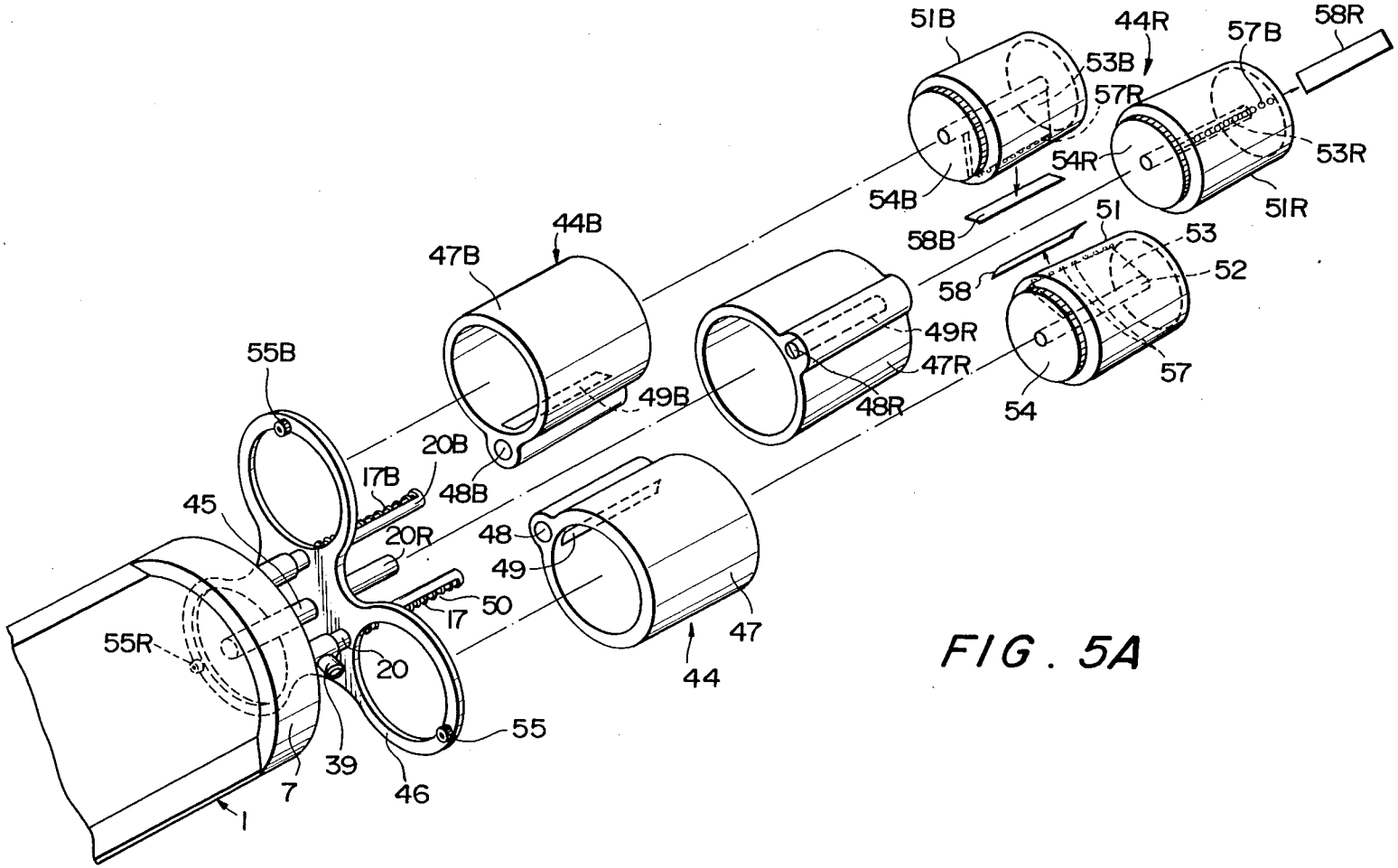
FIG. 5A is an exploded perspective view of toner supply devices which are located outward of the developing unit with respect to an intended mounting and dismounting direction of the developing unit.
Figure 5B:
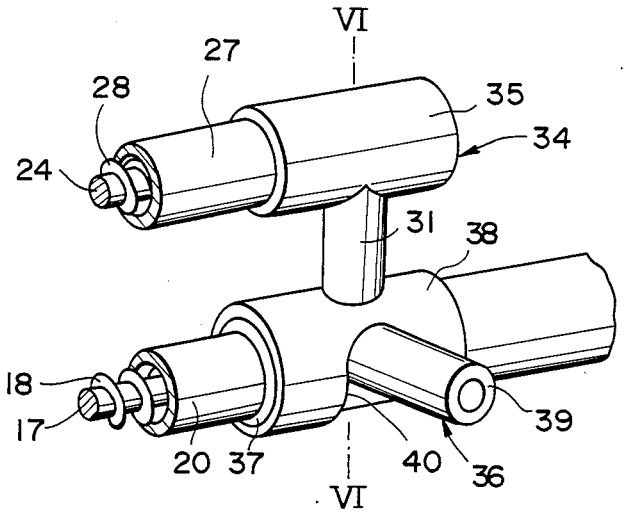
FIG. 5B is a perspective view of an arrangement for changing over the path of a developer.

Specifically, as shown in FIGS. 2, 4, and 5A, a support plate 46 is fixed through a suitable number of studs 45 to the outer end wall 7 of the developing unit 1 with respect to the intended mounting dismounting direction. The previously described toner supply conduit 20 is fixed to and extends throughout the support plate 46. An end portion of the toner supply conduit 20 is inserted in a bore 48 of a substantially cylindrical holder member 47, which constitutes a part of the toner supply device 44. That part of the bore 48 which faces the inward of the holder member 47 is contiguous with an opening 49. This opening 49 is aligned with an opening 50 which is formed by notching the toner supply conduit 20. The transport screw shaft 17, therefore, is rotatably supported in the conduit 20 and exposed to the interior of the holder member 47 through the openings 49 and 50. A toner tank 51 storing toner, black toner in this embodiment, is detachably mounted in the holder member 47 from the right-hand side as viewed in FIG. 2. In FIG. 1, the position of the toner tank 51 is schematically represented by a dash-an-dot line. Disposed in the toner tank 51 is a toner feed member which, in this particular embodiment, is implemented with a rotary body 53 which is rigidly mounted on a rotatable shaft 52. The shaft 52 is journalled to opposite end walls of the toner tank 51, and a gear 54 which is located outside of the tank 51 is fixed to one end of the shaft 52. When the developing unit 1 is mounted in the copier body 2, the gear 54 is meshed with a drive gear 56 which is supported by the copier body 2, through an intermediate gear 55 which is rotatably supported by the support plate 46. The drive gear 56 is held in driven connection with a toner supply motor, not shown, through an intermediate transmission gear. While the body 53 is rotated within the toner tank 51 driven by the toner supply motor, its radially outermost end slides on the inner periphery of the cylindrical toner tank 51.

As shown in FIGS. 2 and 5A, the cylindrical wall of the toner tank 51 is provided with a number of apertures 57 which face the previously mentioned openings 49 and 50 to serve as toner delivery ports. While the apertures 57 are shown arranged in a single array, they may alternatively be arranged in a plurality of arrays, in a zig-zag configuration, or the like as desired.

When a toner supply signal for commanding the supply of toner to the developer chamber 4 is generated, the toner supply motor is driven to rotate the rotary body 53 of the toner supply device 44 which is associated with the developing unit 1. While the body 53 is rotated about the sahft 52 with its free end sliding on the inner periphery of the toner tank 51, it forces the toner stored in the tank 51 toward the transport screw shaft 17 through the apertures 57. Then, the shaft 52 being rotated transports the toner through the interior of the boss portion 32 of the bladed wheel 16, whereby the toner is delivered into the developer chamber 4 through openings, or outlet ports, 33 which are formed through an inner end part of the boss portion 32. This fresh toner is mixed with the developer in the developer chamber 4. In this manner, this embodiment supplies toner by using the developer feeding means adapted to circulate the developer from the developing section, eliminating the need for an exclusive toner feeding means.

When the toner in the toner tank 51 runs out, the toner tank 51 is pulled out from the holder member 47 and replaced with a new one which is filled with fresh toner. In this instance, before the new tank 51 is loaded in the holder member 47, a seal 58, FIG. 5A, which is sticked to the tank 51 to stop the apertures 57 is removed.

The use of a rotatary member for feeding toner from a toner tank per ce is well known in the art. However, it has been customary to form a relatively wide slot through a toner tank in order to feed toner through the slot. This is undesirable because the amount of toner fed out per rotation of the toner feed member is large and because the pressure exerted by the toner per unit cross-sectional area is low, causing the toner to deposite on the tank around the slot to thereby contaminate the tank. In contrast, when toner is fed out through the numerous apertures 57 as in the embodiment, the toner exerts a substantial degree of pressure and, therefore, flows out onto the transport screw shaft 24 just like a jet of liquid. This allows a minimum of contamination of the tank 51 by the toner to occur in the vicinity of the apertures 57 and openings 49 and 50. Hence, a person who intends to pull the toner tank 51 out of the holder member 47 is safeguarded against contamination on his or her hands and cloths. Further, the amount of toner feed per rotation of the rotatable body 53 can be regulated by adequately selecting the diameter and/or number of the apertures 57. While a prior art arrangement has given no special consideration to the amount of toner feed and, therefore, has needed an exclusive means for regulating the amount of feed fed out of a toner tank, this embodiment makes such a means needless and, thereby, simplifies the overall construction.

Figure 7:
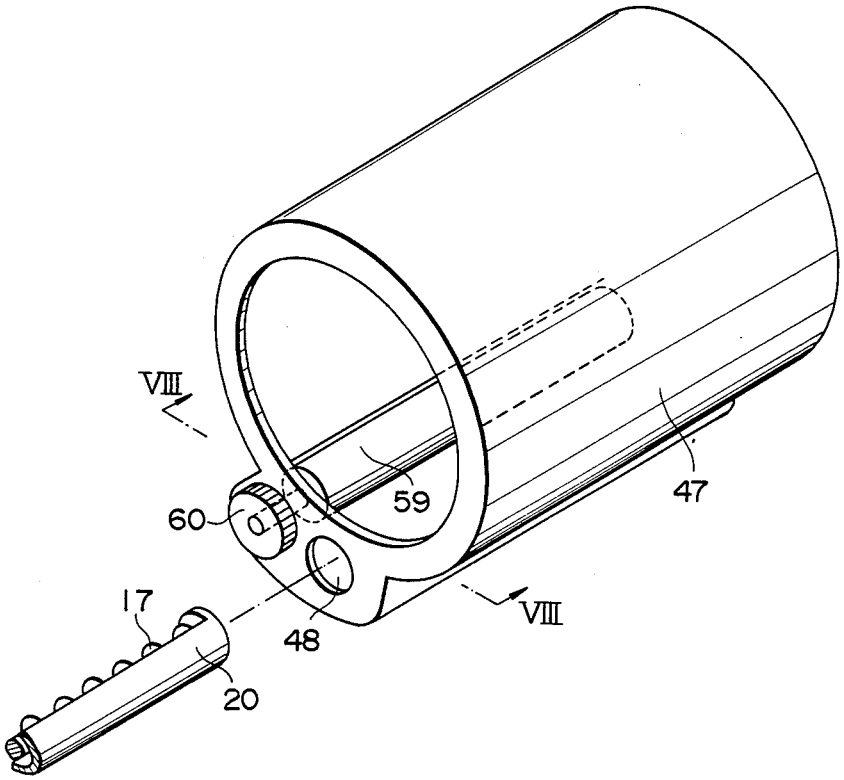
FIG. 7 is a fragmentary perspective view showing another specific construction of the toner supply device.
Figure 8:
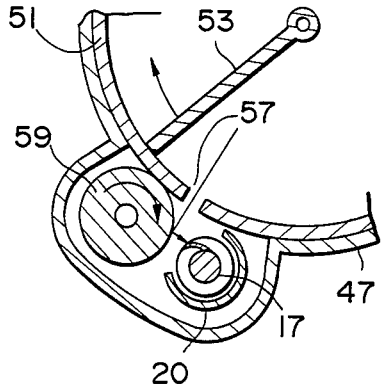
FIG. 8 is a section along line VIII—VIII of FIG. 7, showing a toner supply conduit received in the toner supply device.

FIGS. 7 and 8 show another specific construction which uses an elastic roller 59 made of sponge, foamed material or the like. Specifically, the elastic roller 59 is rotatably disposed in the bore 48 of the cylindrical holder member 47 to extend in parallel to the transport screw shaft 17. The apertures 57 of the toner tank 51 are located in the vicinity of the elastic roller 59. The elastic roller 59 is held in pressing contact with the outer periphery of the toner tank 51. Further, a gear 60 is rigidly mounted on a shaft of the elastic roller 59 and meshed with the gear 54, FIG. 5A, of the body 53. In this configuration, at the time of toner supply, the elastic roller 59 is rotated together with the rotary body 53, and the toner coming out through the apertures 57 is caused to impinge on the roller 59. As a result, the toner bouncing off the roller 59 is directed toward the transport screw shaft 17. Although not shown, a scraper is held in contact with the roller 59 for the purpose of scraping the toner off the roller 59. The pressing contact of the elastic roller 59 with the toner tank 61 is effective to provide sealing between the roller 59 and the tank 61, to prevent toner from being scattered to the outside of the holder member 47, and to maintain the tank 61 clean because toner on the tank 61 is removed by the roller 59.

The drive gear 56, FIG. 4, adapted to drive the rotary body 53 as previously stated is rotatably supported by a lever **56*a* which in turn is pivotally connected to a side plate 83 of the copier body 2 by a pin 56*c*. The lever 56*a* is operated by a toner supply solenoid 56*b* or any other suitable means. As the solenoid 56*b* is energized by a toner supply signal, it pulls the upper end of the lever 56*a* resulting that the drive gear 56 supported by the lever 56*a* is caused into mesh with the intermediate gear 55. FIG. 5A. Upon the deenergization of the solenoid 56*b*, the lever 56*a* is rotated clockwise as viewed in FIG. 4 by the force of a spring, not shown, moving the drive gear 56 away from the intermediate gear 55. In this manner, only when a toner supply signal is generated, the solenoid 56*b* is energized to bring the drive gear 56 into mesh with the intermediate gear 55, whereby the body 53 is rotated to supply the toner. Upon the lapse of a predetermined period of time, the drive gear 56 is released from the intermediate gear 55 to stop the rotation of the body 53 to thereby interrupt the toner supply. As regards the toner supply signal, it may be generated by a toner sensor means, not shown, when the toner density has decreased beyond a predetermined reference value, as well known in the art. Alternatively, by using the fact that toner consumption is substantially proportional to the number of rotations of the developing roller 10, an arrangement may be made such that when the developing roller 10** has been rotated a predetermined number of times, the next toner signal is generated.

Toner supply devices 44R and 4B which are constructed in exactly the same manner as the toner supply device 44 are associated with the other developer chambers 4R and 4B, respectively. Toner is supplied from toner tanks 51R and 51B to the developer chambers 4R and 4B, respectively.

Hereinafter will be described a construction which is adapted to support the developing unit 1.

As shown in FIGS. 1 and 4, a slider 62 is slidably supported by the copier body 2 to be movable into the copier body 2 (in a direction H shown in FIG. 4) and out of the same (in a direction G shown in FIG. 4) guided by a slide guide device 61 which per se is known in the art. A cradle 63 for accommodating the developing unit 1 is supported by the slider 62. In this particular embodiment, the slider 62 and cradle 63 cooperate to constitute a unit carrier for slidably supporting the developing unit 1 on the copier body 2. If desired, the unit carrier which is divided into the cradle 63 and slider may be replaced with a unitary unit carrier.

Figure 9:
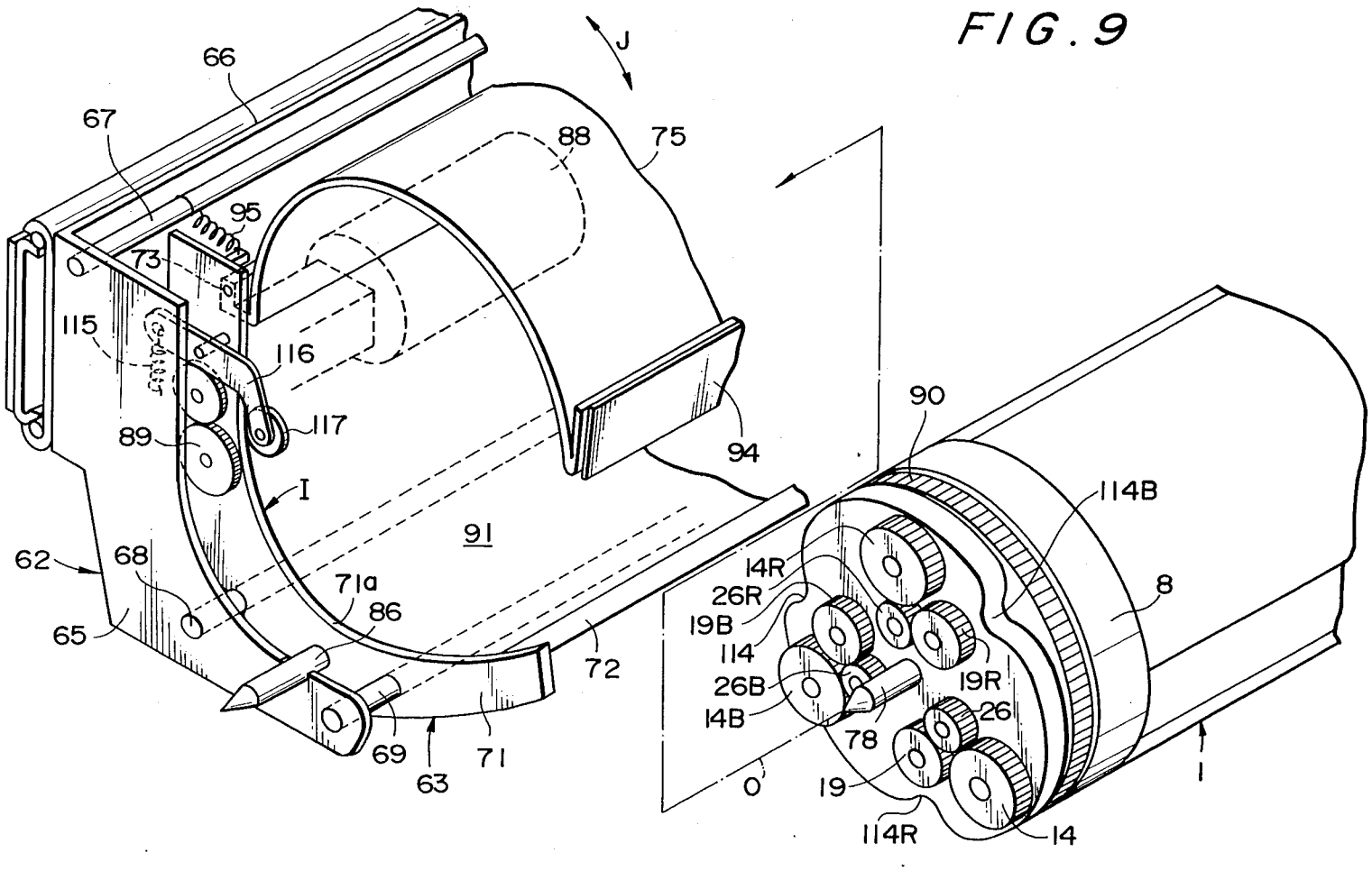
FIG. 9 is a perspective view of the cradle and its associated elements as seen from the inner side, the developing unit being shown removed from the cradle.

As also shown in FIG. 9, the slider 62 includes an outer support plate 64, an inner support plate 65, and a base plate 66 for interconnecting the support plates 64 and 65. Three parallel rods 67, 68 and 69 are each rigidly connected at one end to the support plate 64 and at the other end to the support plte 65, serving to reinforce the support plates 64 and 65.

The cradle 63 includes an outer support arm 70 and an inner support arm 71, FIG. 9, while a lower cover 72 is mounted to the support arms 70 and 71. The support arms 70 and 71 and the lower cover 72 are mounted to the rod 69 in such a manner as to be rotatable in a direction indicated by an arrow I. An upper cover 75 is hinged to the cradle 63 by a pin 73, FIG. 1, to be rotatable as indicated by an arrow J. Usually, the upper cover 75 is held in a closed position as shown in FIG. 9 and as represented by a dash-and-dot line in FIG. 4.

Each of the opposite ends walls 7 and 8 of the developing unit 1 is provided with a cylindrical outer periphery. The upper edges 70*a* and 71*a* of the support arms 70 and 71, respectively, are each provided with an arcutate configuration complementary to that of the outer periphery of the end walls 7 and 8. A plurality of support rollers, two support rollers 76 and 77 in this embodiment, are rotatably mounted on the outer support arm 70 of the cradle 63 so as to support the outer periphery of the outer end wall 7 of the developing unit 1. When the developing unit 1 is pulled out from the copier body 2 through the slider 62, the inner end wall 8 of the unit 1 is rotatably supported by the arcuate upper edge 71*a* of the inner support arm 71, as shown in FIG. 9. In this construction, the developing unit 1 is capable of rotating about its center axis O while being supported by the cradle 63.

The developing unit 1 received in the cradle 63 may be pulled out of the copier body 1 by pulling out the slider 62 in the direction G or set in a predetermined position in the copier body 2 by pushing it in, as previously stated. Specifically, all that is required in loading the developing unit 1 in the copier body 2 is pushing the slider 62 in the direction H, FIG. 4, while maintaining the unit 1 in the cradle 63, as shown in FIG. 1. Immediately before the developing unit 1 is settled at the predetermined position inside the copier body 2, a positioning pin 78 which is studded on the inner end wall 8 of the unit 1 in alignment with the center axis O mates with an opening 80 of an inner side plate 79 of the copier body 2 or with a bearing 81 which is fitted in the opening 80, as shown in FIG. 3. This locates the inner side of the unit 1 in the predetermined position inside the copier body 2. In this instance, as shown in FIG. 1, the inner end wall 8 is slightly spaced upward from the support arm 71 of the cradle 63. In this condition, the inner side of the unit 1 is rotatably supported by the copier body 2 through the positioning pin 78 while being positioned relative to the drum 11. As regards the outer end wall 7, while it remains rotatably supported by the support rollers 76 and 77 even after the developing unit 1 has been set, a pin 82, FIG. 4, which is studded on the outer support arm 70 of the cradle 63 mates with an opening which is formed through an outer side wall 83 of the copier body 2 or with a bearing member 85 which is fitted in that opening. This positions the outer side of the cradle 63 relative to the drum 11. Consequently, the outer end wall 7 of the developing unit 1 is positioned relative to the drum 11 through the cradle 63. In this manner, the entire developing unit 1 is securely located in parallel to the drum 22. Further, the inner side of the cradle 63 is positioned relative to the copier body 2 with a pin 86, FIG. 9, studded on its support arm 71 mating with an opening, not shown, of the inner side plate 79 of the copier body 2. In this embodiment, the pins 78 and 82, bearing 81 and bearing member 85 cooperate to constitute a positioning guide means which will be described.

As described above, the developing unit 1 has its inner side positioned relative to the copier body 2 and its outer side positioned relative to the copier body 2 through the cradle 63 which is positioned relative to the copier body 2. Alternatively, the inner support arm 71 of the cradle 63, too, may be provided with support rollers which are similar to the rollers 76 and 77 of the outer support arm 70. In this alternative construction, after the entire cradle 63 has been positioned relative to the copier body 2 by the pins 82 and 86, the inner end wall of the developing unit 1 is rotatably supported by the support rollers of the inner support arm 71 when the unit 1 is loaded in the cradle 63. This allows the entire unit 1 to be positioned relative to the copier body 2 and, therefore, to the drum 11 through the cradle 63. In such a case, it is needless that the center of rotation O of the developing unit 1 be positioned relative to the copier body 2 by the pin 78. Rather, both the inner and outer sides of the developing unit 1 may be rotatably positioned relative to the copier body 2 at the center of rotation O, in which case the cradle does not have to be accurately positioned relative to the copier body 2.

As described above, because one or both of the cradle 63 and the center O of the developing unit are positioned relative to the copier body 2, the unit 1 is capable of freely rotating about its center O, eliminating the problem particular to the prior art in which a developing roller is positioned relative to a copier body.

Further, a support roller 87, FIG. 4, is mounted on the outer side plate of the copier body 2 to be movable up and down, as will be described. This movable support roller 87 is adapted to press from above the upper end of the outer end wall 7 of the developing unit 1 when the unit 1 is mounted in the copier body 2. Hence, while the unit 1 is set in the copier body 2, its end wall 7 is supported by the three support rollers 76, 77 and 87 allowing the unit 1 to rotate about the center axis O in its predetermined position. The movable support roller 87 is retracted upward when the developing unit 1 is moved into or out of the copier body 2 not to interfere with the unit 1 and others, while being pressed against the end wall 7 when the unit 1 is fully loaded in the copier body 2. When the unit 1 is moved out, it can be freely removed from the cradle 63 since the roller 87 is held clear of the unit 1.

If desired, the outer end wall 7 of the developing unit 1 may be provided with a circumferential groove, not shown, for receiving the rollers 76 and 77. The inner end wall 8 may also be provided with a circumferential groove for receiving the support arm 71 or the roller mentioned earlier. Such would effectively position the developing unit 1 relative to the unit carrier in the longitudinal direction of the unit 1.

When it is desired to develop a latent image by the red toner stored in the developing section 3R or by the blue toner stored in the developing section 3B, the developing unit 1 mounted in the copier body 2 should be rotated clockwise as viewed in FIG. 1 until the developing roller 10R or 10B of the desired developing section 3R or 3B reaches the developing position which, in FIG. 1, the developing roller 10 of the developing section 3 assumes. This also holds true when the developing device is constructed such that the developing sections 3, 3R, and 3B store developers of the same color or such that they each stores a respective one of cyan, magenta and yellow toner to sequentially develop a latent image by such toner to produce a full-color image.

Figure 13:
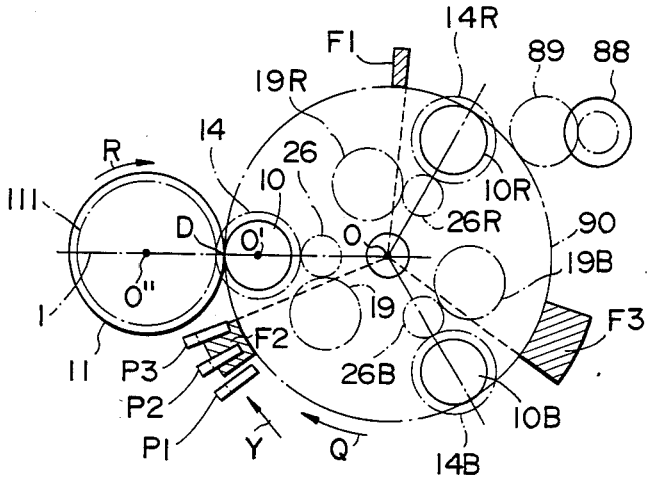
FIG. 13 is a view useful for explaining how the developing unit is rotated.

As shown in FIGS. 9 and 13, an implementation for meeting the above requirement includes a drive motor 88 and a gear 89 which is driven by the drive motor 88. The drive motor 88 and gear 89 are mounted on the cradle 63. The gear 89 is meshed with a unit gear 90 which is provided on the periphery of the inner end wall 8 of the developing unit 1. When the operator depresses a desired one of key switches each being associated with a different color after loading the developing unit 1 in the copier body 2, the drive motor 88 is energized while, at the same time, a clutch interposed between the motor 88 and the gear 89 is coupled. This causes the developing unit 1 to rotate about its center axis O together with the toner supply devices 44, 44R and 44B until the developing roller of a selected one of the developing sections, e.g., developing roller 10 reaches the developing station D. Then, the motor 88 is deenergized or the clutch is uncoupled to stop the rotation of the unit 1, followed by the previously described sequence of developing steps. As shown in FIGS. 1, 4 and 9, the developing sections 3, 3R and 3B and the toner supply devices 44, 44R and 44B of the developing unit 1 are individually distributed radially and evenly about the axis of the unit 1 and, yet, share the same unitary construction. Hence, the center of gravity of the toner supply devices 44, 44R and 44B is located on the center of rotation O of the unit 1, so that the devices 44, 44R and 44B can be rotated smoothly and by small power. In addition, due to the identical configuration of the developing sections 3, 3R and 3B and that of the toner supply devices 44, 44R and 44B, the various structural elements thereof can be implemented with common members to cut-down the production cost.

The advantages attainable with those constructions which are directly related to the present invention are as follows. Because the toner supply devices 44, 44R and 44B are located in that space of the developing unit 1 which is defined in the outer side of the unit 1, the entire developing device is provided with a compact construction, compared to a case wherein toner supply devices are arranged radially outward of their associated developing sections. Further, because the toner supply devices 44, 44R and 44B are disposed in the wide space which is available at the outer side of the unit 1, there can be increased the amounts of toner to be supplied, i.e., the volumes of toner tanks.

However, should the toner supply devices 44, 44R and 44B be disposed at the outer side of the developing unit 1, the toner supply conduits 20 and studs 45 would protrude from the end wall 7 of the unit 1. As previously stated, it has been customary to rotatably support the developing unit 1 about is axis O by studding a shaft on the center of the end wall 7 and supporting the shaft by a bearing. In such a condition, the toner supply conduits 20 and others protruding from the end wall 7 would make it impossible to provide a space for accommodating the bearing adapted to support the shaft, rendering the shaft and bearing type prior art implementation impracticable. In the case that the studs 45 are provided at the center of the end wall 7 as shown and described, even the shaft mentioned above cannot be provided. In the light of this, in this particular embodiment, the outer periphery of the end wall 7 is provided with a cylindrical configuration and supported by three support rollers 76, 77 and 87, as stated earlier. Such allows the developing unit 1 to be rotatably supported despite that the toner supply conduits 20 and others project from the end wall 7. If desired, the support rollers 76, 77 and 87 may each be replaced with a pin, and the end wall 7 may be supported at any desired number of points so long as it is not smaller than two. While the inner side of the developing unit 1 has been shown and described as being rotatably supported with the positioning pin 78 received in the opening 80, it will be apparent that the inner side, too, may be rotatably supported by two at least support members, as previously mentioned. In the case where use is made of a developing unit which is not removable from a copier body, those support members may be provided on the copier body. Because the end walls which define the developer chambers of the developing unit 1 are implemented with cylindrical surfaces, it is needless to provide the unit 1 with special members which are to be supported and would add to the cost. Despite that the end walls 7 and 8 each has a relatively large outside diameter, a compact structure is realized since each of them is supported by fragmentary support members.

The developing device in accordance with this embodiment further includes an implementation for preventing the developer from being scattered around, as will be described hereinafter.

During the developing process previously described or at the time of rotation of the developing unit 1, the developer is apt to leak through the openings of the casing member 5 which the developing rollers 10, 10R and 10B adjoin. Such developer would be scattered around to deposite on and contaminate various structural elements installed in the copier, especially, optical elements, impairing the function of the copier.

To eliminate the above occurrence, the cradle 63 is provided with the upper cover 75 and lower cover 72 which are so arranged as to enclose the developing unit 1 from above and below, respectively. The developing roller 10 which is located in the developing station is exposed to the drum 11 through the gap which is defined between the free end of the upper cover 75 and that of the lower cover 72.

The upper cover 75 is hinged to the cradle 63, as stated earlier. Hence, by pulling out the slider 62 from the copier body 2, the upper cover 75 may be opened as indicated by a solid line in FIG. 4 in order to rotate the developing unit 1 or to remove the unit 1 from the cradle 63, as will be described. In this instance, because the support roller 87 is mounted on the copier body 2, it does not make contact with the developing unit 1 which has been drawn out of th copier body 2 and, hence, the unit 1 can be removed from the cradle 63 without the interference of the roller 87. To put the slider 62 in the copier body 2 again, the upper cover 75 is returned to the dash-and-dot line position as shown in FIG. 4.

The lower cover 72 includes a vessel portion 91, FIGS. 1, 4 and 9, for receiving the developer which may drop from the developing unit 1. By pulling out the slider 62 and removing the developing unit 1 from the cradle 63, the operator may clean the vessel portion 91 of the developer deposited thereon from time to time.

Figure 10:
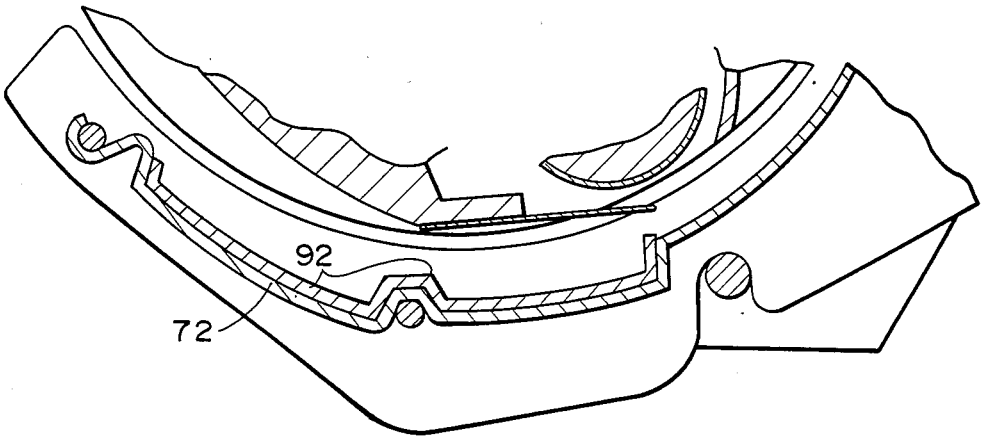
FIG. 10 is a section showing another embodiment of the present invention which is provided with a tray for receiving a developer.

Alternately, as shown in FIG. 10, a tray 92 may be detachably laid on the lower cover 72 to promote the ease of the above-mentioned cleaning. The developer deposited on the tray 92 can be readily removed by removing the tray 92 from the lower cover 72.

In this embodiment, the upper and lower covers 75 and 72, respectively, are made of a non-magnetic material because use is made of a magnetic developer. Should the covers 75 and 72 be made of a magnetic material, the developer on each developing roller would be apt to escape the developer chamber, in which the developing roller is disposed, due to magnetism. Further, should the magnetic developer of any color dropped onto the lower cover 72 or the tray 92 be attracted toward any of the developing rollers 10, 10R and 10B by magnetism, there would occur mixture of the developers of different colors. In this embodiment, such an occurrence is eliminated by locating the vessel portion 91 of the lower cover 72 or that of the tray 92 outside of the reach of the magnetic forces of the magnets 21, 21R and 21B which may move past it. This is why the vessel portion 91 shown in FIG. 1 or the tray 91 shown in FIG. 10 is recessed downward.

As shown in FIG. 1, a casing member portion 150 located downstream of the doctor blade 22 is positioned close to the developing roller 10 to define a relatively narrow gap between itself and the roller 10. This is intended to cause this gap to be filled with the developer which is transported therethrough, thereby preventing the developer from escaping the developer chamber 4.

While the developer is transported by the developing roller 10 during developing operation, it is prevented from being scattered around, especially at the developing station D, by a first seal member 93 as shown in FIG. 1. Specifically, the first seal member 93 is associated with the developing section 3 and fixed to the casing member 5. The seal member 93 may be implemented with an elastic film such as a polyester film, a sheet such as a polyurethane rubber sheet, or an elastic brush. Naturally, such a seal member is associated with each of the other developing sections 3R and 3B. While the developing roller is in the developing station D, the tip of the seal member 93 makes contact with the surface of the drum 11 upstream of the developing station D so as to prevent the developer from being scattered upward beyond the seal member 93.

When the developing unit 1 is rotated, the seal member 93 slides on the periphery of the drum 11. Hence, if the seal member 93 is made of a hard material, it may scratch the drum surface. However, the seal member 93 made of a soft material would fail to press itself against the drum 11 by adequate pressure and, therefore, to offer it expected sealing function during usual developing operation.

To solve the above problem, in this embodiment, a second seal member 94 is provided on the free end of the upper cover 75 and held in contact with the drum 11. Specifically, there are provided two seal members 93 and 94 for sealing the developing roller and its neighborhood. Such a double-seal configuration guarantees positive sealing even if the seal members 93 and 94 are individually made of a soft material which is somewhat poor in sealing ability. The second seal member 94, too, may be implemented with an elastic film or sheet made of synthetic resin, a flexible brush, or the like. If desired, the second seal member 94 may be mounted on any suitable member other than the upper cover 75, e.g. developing unit 1 or the copier body 2.

Both of the first and second seal members 93 and 94, respectively, are supported at one end by the developing unit 1, as shown and described. Therefore, when the developing unit 1 is rotated about its center O, the seal members 93 and 94 are individually deformed in sliding contact with the drum 11. In this condition, should the developing unit 1 be rotated counterclockwise as viewed in FIG. 1, the first seal member 93, for example, would be bent and turned over by the force of the drum 11 as represented by a dash-and-dot line and, in the worst case, broken down. In this embodiment, the developing unit 1 is rotatable clockwise only, as viewed in FIG. 1. This prevents the seal member 93 from being deformed beyond the position which is indicated by a dashed line in FIG. 1, while the developing unit 1 is in rotation. That is, the seal members 93 and 94 as well as the drum 11 are protected against excessive forces otherwise applied thereto from the outside. In short, the developing unit 1 is rotatable only in a direction which minimizes the bending deformation of the seal members 93 and 94.

The developing unit described above needs cleaning, inspection, adjustment (e.g. adjustment of the positions of the doctor blades 22, 22R and 22B) and repair either periodically or as occasion arises. All that is required for such an operation is pulling the slider 62 out of the copier body 2 together with the developing unit 1, and raising the upper cover 75 to the open position as shown in FIG. 4. This allows the operator to readily complete the operation without getting his or her hands and cloths stained with the developer. The developing unit 1 with three developing units 3, 3R and 3B as in this embodiment has to be accessible over its entire circumference. This need is fully met because, as stated earlier, even when the slider 62 is pulled out, the end walls 7 and 8 of the developing unit 1 are rotatably supported by the two support rollers 76 and 77 of the cradle 63 and the upper edge **71*a* of the support arm 71, respectively. Therefore, a person may freely rotate the developing unit 1 on the cradle 63 to make access to any desired part of the unit 1. This promotes the ease and efficiency of operation When the developing unit 1 is loaded in the copier body 2 and, for example, the developing roller 10 of the developing section 3 is brought to the developing station D, the roller 10 faces the drum 11 with a narrow gap left therebetween. In the case that a one-component developer is used, the developing roller 10 may be pressed against the drum 11. For these reasons, the developing unit 1 and cradle 63 are held in contact with the drum 11 or, as in this embodiment, located close to the drum 11. Hence, if the cradle 63 is moved into and out of the copier body 2 in the above condition, there is a fear that a part of the cradle 63 or that of the developing unit 1 interferes with the drum 11 to scratch the drum surface and/or the drum 11 shaves the developer off the developing roller 10** to cause it to contaminate the developing device and the neighborhood of the copier.

In the light of the above, the developing device in accordance with this embodiment is constructed such that when the developing unit 1 is mounted and dismounted from the copier body 1, the unit 1 and cradle 63 are shifted away from the drum 11 and, when the unit 1 is loaded in the copier body 2, it is located in a predetermined position adjacent to the drum 11, as will be described in detail hereinafter.

As shown in FIGS. 4 and 9 and stated earlier, the cradle 63 is rotatably mounted on the rod 69 of the slider 62 and movable toward and away from the drum 11. A plurality of tension springs 95 (see FIG. 1 also) are loaded between the cradle 63 and the slider 62 to constantly bias the cradle 63 away from the drum 11 about the rod 69, as indicated by an arrow I. When the cradle 63 is pulled out from the copier body 2, the cradle 63 is abutted against the slider 62 and, as shown in FIGS. 4 and 9, held in the opposite side to the drum 11. It is to be noted that the tension spring 95 is an illustrative biasing means and may be replated with any other elastic member or even by an arrangement in which the developing unit 1 and cradle 63 are biased in the direction I due to gravity, i. e. their own weight.

Figure 11:
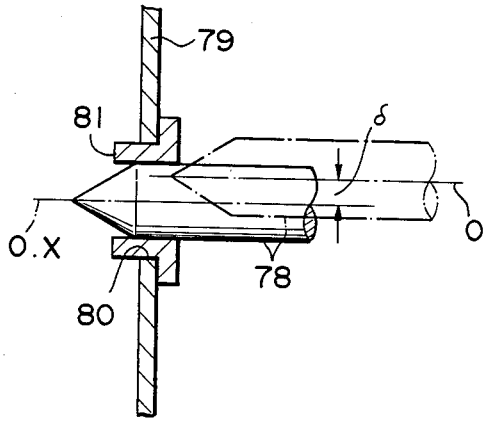
FIG. 11 is a view showing how a positioning pin is mated with an opening.

When the slider 62 is moved into the copier body 2 as indicated by an arrow H, the cradle 63 and developing unit 1 which are biased toward the slider 62 by the springs 95 are prevented from interfering with the drum 11. As previously described, immediately before the slider 62 reaches the predetermined deepest position in the copier body 2, the positioning pin 78, FIG. 3A, of the developing unit 1 mates with the opening 80 of the side plate 79 through the bearing 81 while, at the same time, the pin 82 of the support arm 70 of the cradle 63 mates with the opening of the side plate 83 through the bearing 85. Each of the pins 78 and 82 is provided with a tapered tip. Hence, as these tapered pins 78 and 82 are moved deeper into their associated openings, the cradle 63 is rotated about the rod 69 together with the developing unit 1 against the action of the springs 95 and, therefore, it approaches the drum 11. Specifically, as shown in FIG. 11, before the pin 78 mates with the bearing 81, its center axis O is offset by a distance of δ from the axis X of the bearing 81 and away from the drum 11. However, as the tip of the pin 78 begins to mate with the bearing 81, the axis O of the pin 78 sequentially approaches the axis X of the bearing 81 with the tapered end guided by the bearing 81. When the pin 78 is fully received in the bearing 81, the two axes O and X are aligned. Such a relationship is also true with the pin 82 and the bearing member 85. After the cradle 63 and developing unit 1 have been fully set as stated above, they stand closer to the drum 11 by the distance δ so that the developing roller 10 is accurately positioned in parallel to and at a short spacing from the drum 11.

It is to be noted that, in this embodiment, upon the completion of setting the pin 78 is raised slightly upward by the bearing 81 to maintain the inner end wall 8 spaced upward from the upper edge 71*a* of the inner support arm 71.

On the other hand, while the cradle 63 is moved out of the copier body 2, the pins 78 and 82 are sequentially released from their associated bearings 81 and 85, respectively. As a result, the cradle 63 is urged away from the drum 11 by the springs 95 together with the developing unit 1 and, therefore, the cradle 63 and developing unit 1 are dismounted without making contact with the drum 11.

Needless to say, the means for moving the developing unit 1 and cradle 63 toward and away from the drum 11 as described above may alternatively be implemented with direct mating of the pins 78 and 82 with their associated holes 80 and 84 or with any other suitable guide members.

As stated above, in this embodiment, the pins 78 and 82, bearing 81 and bearing member 81 constitute a positioning guide member in cooperation. Specifically, when the developing unit 1 is set in a predetermined position in the copier body 2 relative to the drum 11, the positioning guide means serves to position the outer side of the cradle 63 and the center O of the unit 1 on the inner side of the unit 1 against the action of the spring 95. When the unit carrier is to be slid together with the unit 1, the cradle 63 and unit 1 are shifted away from the drum 11 by the spring 95 and, thereby, freed from the restraint.

When the developing unit 1 is loaded in the copier body 2, its outer end wall 7 is supported by the two support rollers 76 and 77 from below and pressed by the movable support roller 87 from above. The roller 87 is mounted on the copier body 2 as stated in order to allow the developing unit 1 to be freely pulled out without being interfered by the roller 87. Further, the roller 87 is movable up and down as also stated in order to prevent it from interfering with the cradle 63 and developing unit 1 when the unit 1 is to be moved in and out. Hereinafter will be described, with reference to FIG. 12, a specific example o a means for implementing the up-down movement of the roller 87, i.e., a means for moving the support roller 87 away from the developing unit 1 when the unit 1 is loaded and unloaded from the copier body 2 and causing it into pressing contact with the end wall 7 of the unit 1 when the unit is set in the predetermined position inside the copier body 2.

Figure 12:
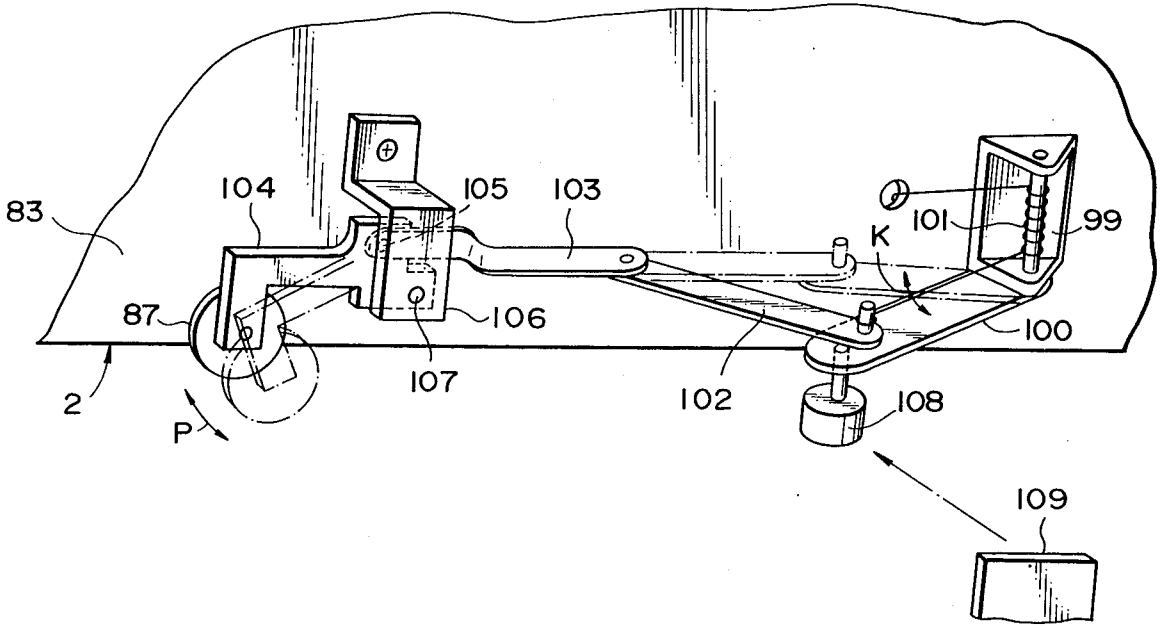
FIG. 12 is a perspective view showing a mechanism for moving a support roller up and down.

In FIG. 12, an arm 100 is supported by a bracket 99 which is fixed to the outer side plate 83 of the copier body 2. The arm 100 is free to rotate in a horizontal plane in a direction indicated by an arrow K in the drawing. A torsion coil spring 101 is provided for constantly biasing the arm 100 outward, as represented by a solid line in the figure. A first link 102 is pivotally connected at one end thereof to a free end portion of the arm 100 while a second link 103 is pivotally connected to the other end of the first link 102. The other end of the second link 103 is connected by a pivot pin 105 to a support member 104 on which the support roller 87 is rotatably mounted. The support member 104 is pivotally mounted on the side plate 83 by a pin 107 to be rotatable as indicated by an arrow P. This pin 107 is located below the position where the link 103 is connected to the support member 104. Further, a roller 108 is disposed below and supported by the free end portion of the arm 100.

While the cradle 63 and developing unit 1 are pulled out, the arm 100 is positioned as indicated by the solid line in FIG. 12 by the spring 101 while, at the same time, the support roller 87 is retracted from the path of movement of the cradle 63 to a solid-line position. In this condition, the cradle 63 and developing unit 1 may be moved into the copier body 2 without encountering the interference of the support roller 87. Immediately before the cradle 63 reaches its predetermined deepest position in the copier body 2, a presser member 109 (see FIG. 4 also) provided on the slider 62 urges the roller 108 toward the copier outer end 2. Then, the arm 100 which carries the roller 109 therewith is rotated to a position indicated by a dash-and-dot line in the figure, resulting that the support member 104 is urged to the left through the links 102 and 103 to rotate counterclockwise about the pin 107. Consequently, the support roller 87 is lowered to a position which is indicated by a dash-and-dot line in the figure. At this moment, the outer end wall 7 of the developing unit 1 has just arrived at position below the roller 87. Hence, the roller 87 is caused into pressing contact with the periphery of the end wall 7 by the action of the spring 101. At this instant, the torsion coil spring 101 urges the roller 87 against the end wall 7.

A procedure opposite to the above-described one occurs when the developing unit 1 is pulled out of the copier body 2. This procedure, too, can be completed with the support roller 87 prevented from interfering with the unit 1 and cradle 63.

At least one of those support rollers 76, 77 and 87 which are adapted to support the end wall 7 may also be held in such a manner as to be movable toward and away from the end wall 7. That is, it is not always necessary that the roller 87 only be supported in a movable manner.

The support roller 87 adapted to press the top of the end wall 7 may be replaced with a support roller 87 which, as indicated by a dash-and-dot line in FIG. 1, is rotatably mounted on the upper cover 75, for the purpose of omitting the up-down oscillation mechanism shown and described. When the developing unit 1 is moved into and out of the copier body 2, the upper cover 75 is held closed as shown in FIG. 1, so that the alternative roller 87a does not interfere with the unit 1. When the developing unit 1 is to be removed from the cradle 63 at the outside of the copier body 2, too, the support roller **78*a* does not obstruct the movement of the unit 1 because the upper cover 75 is openable to the solid-line position as shown in FIG. 4. All that is required in such an alternative arrangement is mounting the roller 78*a* rotatably on the upper cover 75. The upper cover 75 may advantageously be biased toward the end wall 7 by a spring, not shown, in order to cause the roller 78*a* into pressing contact with the end wall 7 when the upper cover 75 is closed. Another possible scheme is such that the upper cover 75 is made of synthetic resin or like elastic material, the cover 75 is stopped at a predetermined position as shown in FIG. 1 when closed, and, when the developing unit 1 is loaded in the copier body 2, a presser member mounted on the copier body 2 presses the elastic upper cover 75 downward to bring the roller 78*a* into contact with the end wall 7**.

As stated earlier, the developing roller 10 and the two transport screw shafts 24 and 17 which are brought to the developing station D are driven by the individual gears 14, 26 and 19. In this condition, as shown in FIGS. 9 and 13, the developing roller gear 14 is meshed with the gear 26 which is rigid on the screw shaft 24, and the gear 26 is in turn meshed with the gear 19 which is rigid on the other screw shaft 17. As the gear 15 is rotated, the other gears 26 and 19 are rotated also. This is true with the gears of the other developing sections as well. In this instance, installing a different drive source for each of the developing rollers of the developing sections would add to the overall size and cost of the device. In this particular embodiment, as shown in FIGS. 3 and 13, a drive gear 111 is rotatably but axially unmovably mounted on a shaft 110 of the drum 11 which is journalled to the opposite side plates 78 and 83 of the copier body 2. Assuming that the developing section 3 is brought to the developing station D, the gear 14 of the developing roller 10 is brought into mesh with the drive gear 111 so that, as a motor, now shown, is energized, the developing roller 10 and screw shafts 24 and 17 are rotated through the gears 111, 14, 26 and 19. The centers of the developing roller gears 14, 14R and 14B are equally spaced from each other and located at the same distance as measured from the center O of the developing unit 1. By rotating the developing unit 1 about its center O, the other developing sections 3R and 3B may also be brought to the developing station one at a time, causing their gears 14R and 14B into mesh with the drive gear 111. Such allows a single drive source to drive all the developing sections 3, 3R and 3B. If desired, the drive gear 111 may be supported at any suitable position other than that on the developing unit 1.

FIG. 13, like FIG. 1, shows the developing roller 10 of the developing section 3 located in the developing station D and its gear 14 held in mesh with the drive gear 111. To cause the gears 14A and 14B of the other developing sections 3R and 3B into mesh with the drive gear 111 one at a time, the drive motor 88 stated earlier is energized to rotate the gear 89 and the unit gear 90 of the developing unit 1 and, thereby the unit 1 clockwise as indicated by an arrow Q. This causes the gears 14, 14A and 14B to rotate about the center axis O of the unit 1 until a desired one of the gears 14A and 14B reaches the developing station D.

Figure 17:
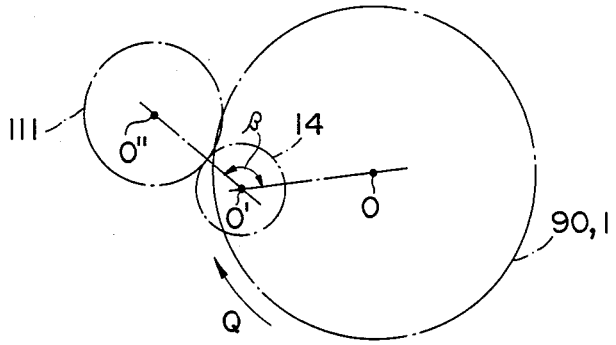
FIG. 17 is a schematic diagram useful for explaining a problem inherent in an arrangement wherein the gears are not aligned on one line.

As shown in FIG. 13, assuming that the center of rotation of the developing roller gear 14 is O′ and that of the drive gear 111 is O″, the centers of rotation O′ and O′ and the center of rotation, or center axis, O of the developing unit 1 are positioned on or substantially on the same line l. Hence, when the developing unit 1 is rotated about the center O together with the gears 14, 14R and 14B, the gears 14, 14R and 14B do not interfere with the drive gear 111. As shown in FIG. 17, assuming that the centers O, O′ and O″ are not located on the same line, i.e., $<OO'O''=\beta$ is smaller than 180 degrees, when the gears 14, 14R and 14B rotate about the center O in the direction Q, they interfere with the drive gear 111 to be thereby prevented from rotating. In such a case, therefore, an extra mechanism for retracting the drive gear 111 from the path of rotation of the gears 14, 14R and 14B during the rotation of the latter is needed to complicate the overall construction.

Figure 18:
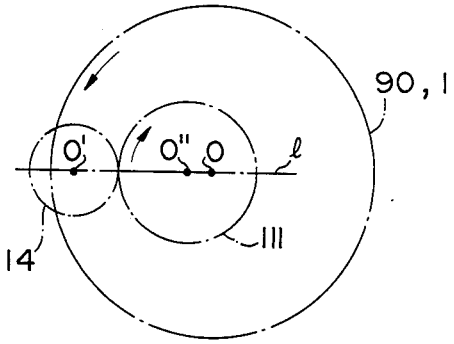
FIG. 18 is a schematic diagram showing another arrangement of the gears.

As shown in FIG. 18, the drive gear 111 may be located radially inward of the gear 14 of the developing roller 10 which is positioned at the developing station D. In this configuration, too, each of the gears 14, 14R and 14B is capable of rotating about the center O without interfering with the drive gear 111 only if the centers O' and O'' of the gears 14 and 111 and the center O of the developing unit 1 are located on or substantially on the same line l.

Figure 19:
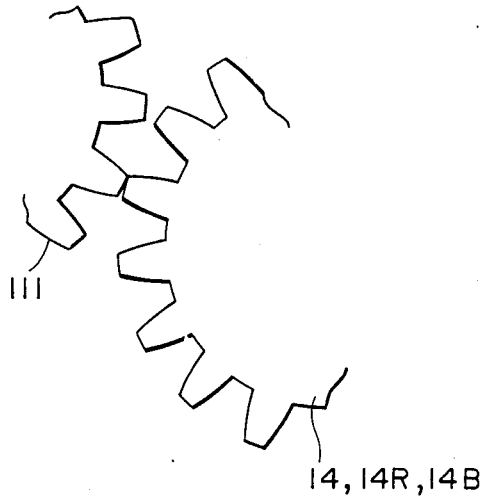
FIG. 19 is a schematic diagram for explaining the collision of the tips of gear teeth.

When any one of the gears 14, 14R and 14B begins to mesh with the drive gear 111 as the developing unit 1 is rotated, there is a fear that the tooth of, for example, the gear 14 and that of the drive gear 111 collide against each other, as shown in FIG. 19. Such would stop the movement of those gears or break them down. To eliminate this, in this embodiment, an arrangement is made such that the drive gear 111 begins to rotate clockwise (arrow R) as viewed in FIG. 13 before the gear 14 begins to mesh with the drive gear 111. Specifically, when the gear 14 being rotated about the center O of the developing unit 1 begins to mesh with the drive gear 111, the drive gear 111 has already started to rotate. Then, even if the tooth of the gear 14 and that of the drive gear 111 collide against each other when the gear 14 begins to mesh with the gear 111, the collision is immediately rid by the rotation of the drive gear 111 so that the gears 14 and 111 attain their correct meshing condition. As regards the rotation start timing of the drive gear 111, it may be selected as desired insofar as it is immediately before the timing at which any of the gears 4, 4R and 4B starts meshing with the drive gear 111. Hence, the drive gear 111 may be caused to start rotating at the instant when any of the previously mentioned key switches for color change is depressed to rotate the developing unit 1 or, alternatively, the drive gear 111 may be continuously rotated while the power supply of the copier is in an ON state.

Further, as previously stated, the drive gear 111 is rotated in the direction R as viewed in FIG. 13 before any of the gears 14, 14R and 14B meshes with it, and the direction in which the gears 14, 14R and 14B rotate about the center axis O of the developing unit 1, too, is clockwise as indicated by the arrow Q. Specifically, the direction of movement of the drive gear 111 and that of, for example, the gear 14 are opposite to each other in their meshing region, i.e. , the rotation directions of the gears 14 and 111 are predetermined such that the relative speed increases in the meshing region. This serves to bring the gears 14 and 111 out of the previously stated colliding state more accurately and more rapidly.

In the case that, for example, the gear 14 and the drive gear 111 are arranged as shown in FIG. 18 and the gear 14 is rotated counterclockwise, the drive gear 111 is rotated counterclockwise. Hence, when the gear 14 being rotated about the center O of the developing unit 1 is brought into mesh with the drive gear 111, it rotates the drive gear 111 counterclockwise. At this instant, therefore, the relative speed of the gears 14 and 111 may be increased by causing the developing unit 1 to rotate counterclockwise. In any case, the gist is that the rotation direction of the unit 1 is selected such that the relative speed in the meshing region of the gears14 and 111 is increased.

Alternatively, the gear 14, instead of the drive gear 111, may be caused to start rotating about its center O' by any suitable drive means other than the drive gear 111 at a suitable timing immediately before the gears 14 and 111 mesh with each other. Furthermore, the gear 14 and 111 may be individually driven to rotate about their centers O' and O'', if desired.

Hereinafter will be described a more specific example of the construction described above, and a specific construction for positioning the developing rollers 10, 10R and 10B at a predetermined position one at a time and for determining which one of the developing sections 3, 3R and 3B has been located at the developing station D.

As shown in FIG. 13, for example, the same number of sensors P1, P2 and P3 as the developing rollers 10, 10R and 10B are arranged in sequence in predetermined positions around the developing unit 1 and upstream of the developing station D with respect to the rotation direction (arrow Q) of the developing unit 1. Light intercepting plates F1, F2 and F3 which are different in circumferential length from each other are mounted on the developing unit 1 at equally spaced locations along the circumference of the unit 1.

Figure 14:
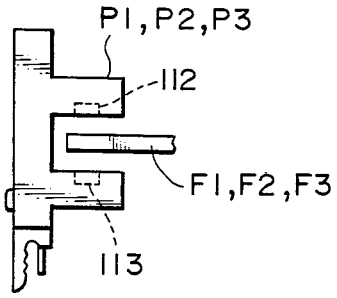
FIG. 14 is a view as seen in a direction indicated by an arrow Y in FIG. 13.

When the developing unit 1 is rotated in the direction Q until its center of rotation O, that O' of the developing roller 10, and that O'' of the drum 11, i. e. , drive gear 111 are aligned on the line l, the light intercepting plate or light interceptor F2 turns the sensors P2 and P3 OFF. Each of the sensors P1 to P3 is assumed to be implemented with a photocoupler which per ce is well known in the art, and appears as shown in FIG. 14 when seen in a direction indicated by an arrow Y in FIG. 13. In the condition shown in these figures, the light interceptor 113 intercepts the light issuing from a light-emitting element 112 so that a light-sensitive element 113 associated with the element 112 is turned OFF. That is, in the case of FIG. 13, only the sensors P3 and P2 are turned OFF. Likewise, when the gear 14R is meshed with the drive gear 111 to locate the developing roller 10R at the developing station D, the light interceptor F1 makes only the sensor P3 OFF. Further, when the gear 14B is meshed with the drive gear 111 to locate the developing roller 10B at the developing station D, the light interceptor F3 turns all the sensors P1 to P3 OFF. The relationship between the developing rollers 10, 10R and 10B and the sensors P1, P2 and P3 described above is shown below in Table 1.

TABLE 1

| DEV ROLLER | SENSOR P1 | P2 | P3 |
|---|---|---|---|
| 10 | ON | OFF | OFF |
| 10R | ON | ON | OFF |
| 10B | OFF | OFF | OFF |

As shown in Table 1, the combination of ON and OFF states differ from one developing roller to another and, hence, which one of the developing rollers has been brought to the developing station D can be determined. That is, there can be sensed that a particular one of the the developing rollers 10, 10R and 10B selected by one of the color change key switches has reached the developing station D.

The light interceptors F1 to F3 are exemplary members which are rotatable integrally with the developing unit 1 to turn the sensors P1 to P3 ON and OFF and change the ON-OFF combination depending upon the developing roller which arrives at the developing station. It is to be noted that, depending upon the configuration of such members and the kind of the sensors, the relationship between the developing rollers and the sensors as shown in Table 1 with respect to ON and OFF states may be reversed, such as shown below in Table 2.

TABLE 2

| DEV ROLLER | SENSOR P1 | P2 | P3 |
|---|---|---|---|
| 10 | OFF | ON | ON |
| 10R | OFF | OFF | ON |
| 10B | ON | ON | ON |

In Table 1, the sensor P3 is turned OFF for all the developing rollers 10, 10R and 10B. Specifically, the sensor P3 is turned off whichever the developing roller located in the developing station D may be. On the contrary, in Table 2 it is turned ON without exception. The OFF state (Table 1) or the ON state (Table 2) of the sensor P3, therefore, is representative of the arrival of an unspecific developing roller at the developing station D.

Figure 15:
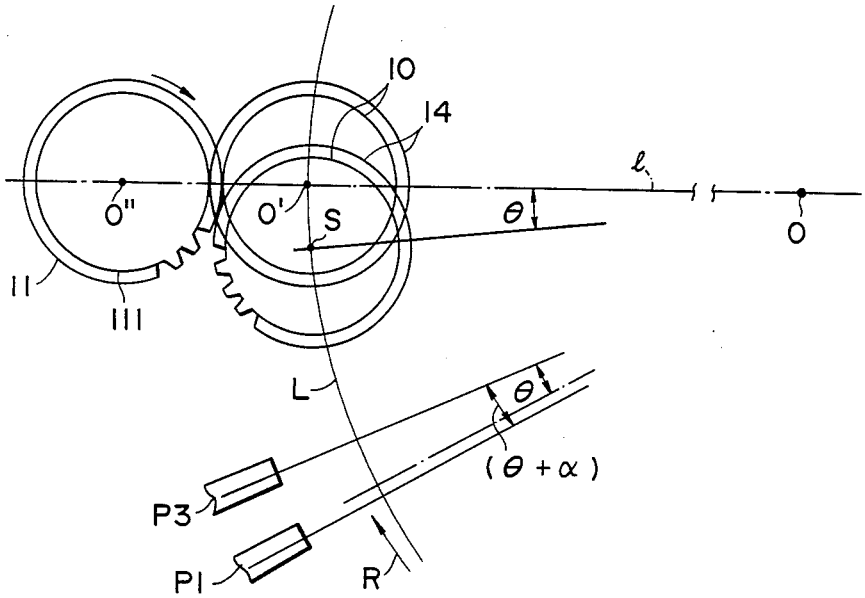
FIG. 15 is schematic diagram showing a relationship between a developing roller gear, a drive gear, and sensors.

FIG. 15 is a schematic diagram showing a process in which, for example, the gear 14 is brought into mesh with the drive gear 111. In the figure, a line L is representative of the locus of the center of rotation O' of the gear 14 which is rotated about the center O of the developing unit 1. As shown, when the center of rotation O' of the gear 14 reaches a point S as the developing unit 1 is rotated, the tip circle of the gear 14 and that of the drive gear 111 make contact with each other. Usually, the gear 14 is then expected to arrive at the line l to correctly mesh with the drive gear 111. However, it may occur that the tips of the gears 14 and 111 collide against each other to lock the gears 14 and 111, as previously discussed.

In FIG. 15, let the angle between the line connecting O' and O and the line connecting S and O be $\theta$. So long as the angle A between the line connecting the most downstream sensor P3 with respect to the rotation direction of the unit developing unit 1 and O and the line connecting the upstream sensor P1 and O is equal to the angle $\theta$ (<O'OS), the light interceptor F2, FIG. 13, should reach the sensor P1 upon the arrival of the gear 4 at the point S and, then, reach the sensor P3 upon the arrival of the same at the developing station D. In this particular embodiment, however, the most upstream sensor P1 is located at a position where the angle A is slightly greater than the angle $\theta$ (<O'OS), i. e., $(\theta+\alpha)$. Immediately before any of the gears 14, 14R and 14B meshes with the drive gear 111, one of the light interceptors F1 to F3 turns the sensor P1 ON or OFF so that the drive gear 111 is rotated by the resulting output of the sensor P1. Then, as soon as the developing roller of the selected developing section reaches the station D, such is sensed by the sensors P1 to P3 as stated earlier resulting that the drive motor 88 or the clutch associated therewith is deenergized. In this manner, by causing the drive gear 111 to start rotating immediately before any of the gears 14, 14R and 14B meshes therewith, it is possible to bring the gears 111 and any of the gears 14, 14R and 14B into mesh correctly.

Figure 16:
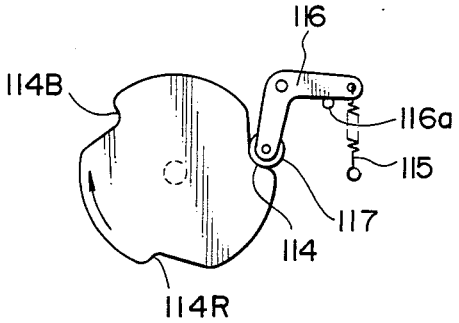
FIG. 16 is a view of cam recesses and a stop roller as seen from the outer side.

As shown in FIGS. 9 and 16, the inner end wall 8 of the developing unit 1 is provided with cam recesses 114, 114R and 114B which are respectively associated with the developing sections 3, 3R and 3B. A fever 116 is pivotally connected to the inner support arm 71 of the cradle 63 and constantly biased by a tension spring 115 toward the end wall 8. A stop 117 in a form of roller is rotatably supported by the lever 116. The stop roller 117 is selectively engageable with the cam recesses 114, 114R and 114B to apply a braking force to the developing unit 1. Specifically, when the roller 117 is engaged with any of the cam recesses 114, 114R and 114B, one of the developing rollers 10, 10R and 10B which is associated with that cam recess is positioned at the developing station D. During developing operation, the developing roller 10 of the developing section 3, for example, is rotated counterclockwise as viewed in FIG. 1 or 13 about its own axis. The resulting load (load due to circulation of developer) is great enough to develop a counterclockwise moment in the developing unit 1 about the center O. At this instant, however, the stop roller 117 being engaged with the cam 117 cancels the counterclockwise moment and, thereby, prevents the developing unit 1 from being rotated by such a moment. Furthermore, the developing unit 1 is so constructed as to rotate in the clockwise direction Q opposite to the direction of moment which is exerted by the developing roller, i.e., the rotation of the unit 1 in the opposite direction to the direction Q is inhibited by the drive motor 88 and its associated gearing. This also contributes to the prevention of the counterclockwise rotation of the unit 1 as stated above.

As shown in FIG. 16, a stop **116*a* is provided for limiting the movement of the stop roller 117. At least one of the surface of the roller 117 and those of the cam recesses 114, 114R and 114B may advantageously be constituted by an elastic material in order to reduce the shock as entailed by the movement of the roller 17 into and out of the cam recesses 114, 114R and 114B**.

Thus, the developing unit 1 can be positioned and the collision of tooth tips of the drive gear 111 and any of the gears 14, 14R and 14B can be removed, each by a simple arrangement as discussed above with reference to FIGS. 13 and 16.

As previously stated, when the toner in the toner tank becomes short or runs out, the toner tank has to be replaced with a new one. To alert the operator to such a condition, the toner supply device in accordance with the present invention is provided with a toner end sensing and displaying capability. A specific arrangement for accomplishing this capability will be described hereinafter.

The apertures 57 which are formed through the toner tank 51 as shown in FIG. 5 have a definite total area. Therefore, the amount of toner fed out by one rotation of the body 53 is constant. Stated another way, the amount of toner remaining in the toner tank 51 decreases with the increase in the number of rotations of the body 53. It follows that the decrease of toner in the toner tank 51 to a critical degree and, hence, the need for the replacement of the toner tank 51 can be known based on the frequency or the amount of operation of the body 53 or its associated element.

Figure 20:
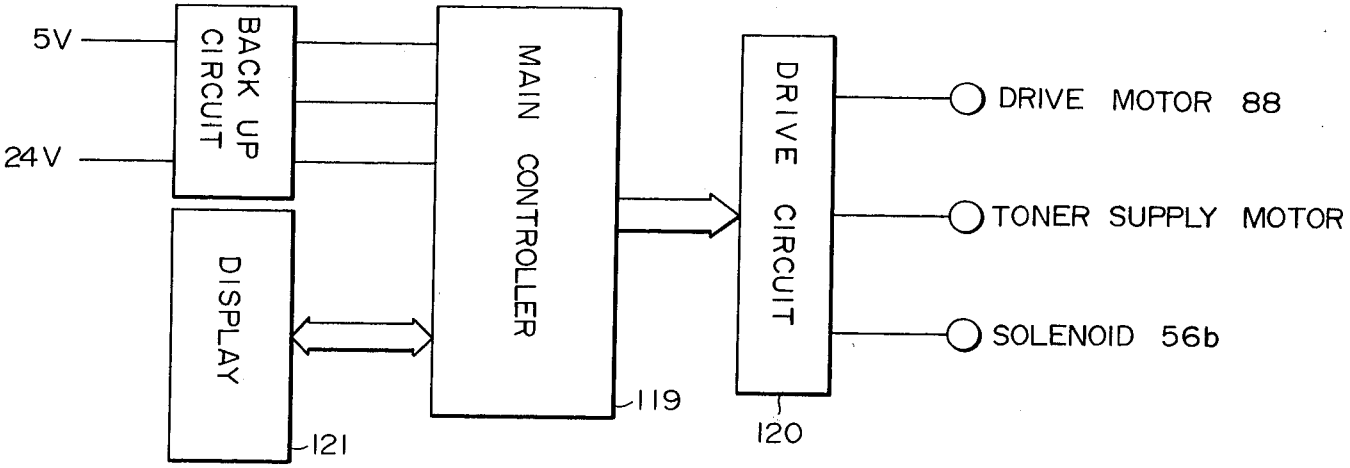
FIG. 20 is a schematic block diagram showing a main controller and those devices which are controlled thereby.

Referring to FIG. 20, there are shown in a schematic block diagram a main controller 119 built in the copier body 2, a drive circuit 120, a toner supply motor for actuating the drive gear 56, FIG. 3, a toner supply solenoid **56*b* for causing the drive gear 56 into mesh with the intermediate gear 55, and a display 121 for displaying the end of toner. The drive circuit 120 and the display 121 are controlled by the main controller 119**.

Figure 22:
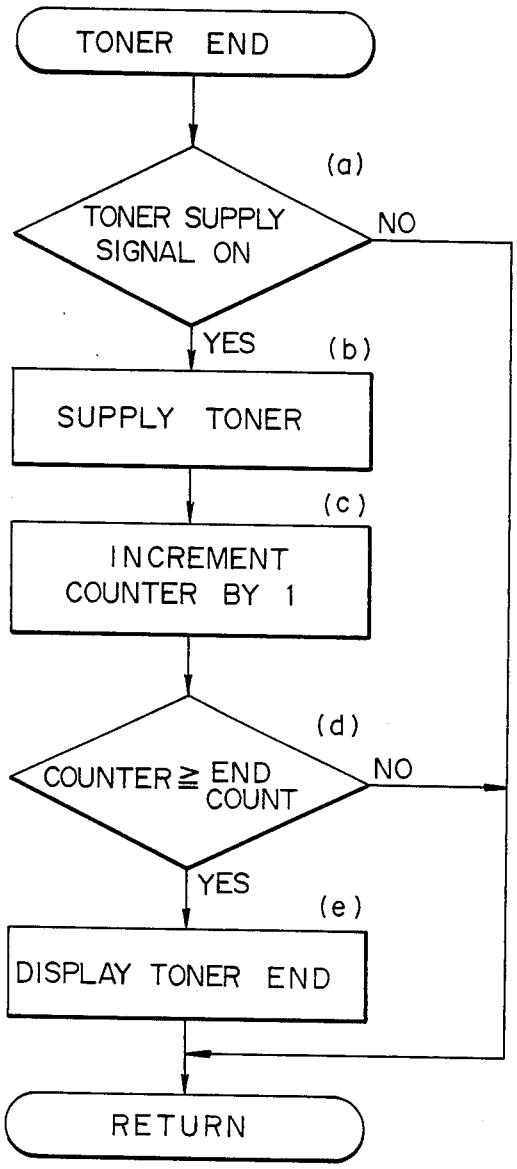
FIG. 22 is a flow chart demonstrating a specific sequence of steps for displaying that the timing for replacing a toner tank has been reached.

FIG. 22 is a flowchart demonstrating an exemplary sequence of steps associated with toner end display. As shown, when a toner supply signal is produced as stated earlier (a), it energizes the toner supply solenoid **56*b* resulting that the rotary body 53 begins to rotate to start feeding the toner (b). At this instant, a preset counter is incremented by one to store the frequency of operation of the toner supply solenoid 56*b* (c). Every time the toner supply signal appears, the procedure described above is repeated to increment the present counter. When the preset counter reaches a predetermined count representative of the decrease of the amount of toner in the toner tank 51 to zero or to below a predetermined one, i.e., end count (d), a toner end signal is produced to energize the display 121 for indicating the end of toner. This will urge the operator to replace the toner tank 51** with a new one.

Figure 21:
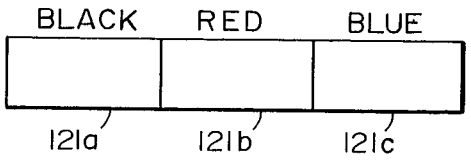
FIG. 21 is a view of a disaply for alerting a person to the end of toner on a developing section basis.

The procedure described above would suffice if a single developer chamber were installed. However, in the case that a plurality of developing sections, three in this embodiment, are provided, toner is supplied to each of the other developing sections 3, 3R and 3B as well. The toner supply solenoid **56*b*, therefore, is also operated when toner is to be delivered to any of the developer chambers 4R and 4B of those developing sections 3R and 3B. In such a case, an arrangement is made such that for which one of the developing units the toner supply solenoid 56*b* has been actuated is determined, the frequencies of operation of the solenoid 56*b* associated with the respective toner supply devices are counted by individual counters, and the counts of the individual counters are each compared with a predetermined end count to provide toner end display. For this purpose, as shown in FIG. 21, the display 121 is constituted by indicators 121*a*, 121*b* and 121*c* which respectively correspond to the toner tanks 51, 51R and 51B** of the respective toner supply devices.

Another possible approach for toner end display in accordance with the present invention is storing, or counting, the frequency of operation of an operable member other than the toner supply solenoid **56*b*, e. g. , the number of rotations of the rotary body 53, the frequency of movement of the lever 56*a* or the frequency of energization of the motor for actuating the lever 56*a***, and generating a signal when such a frequency reaches a predetermined one.

Figure 23:
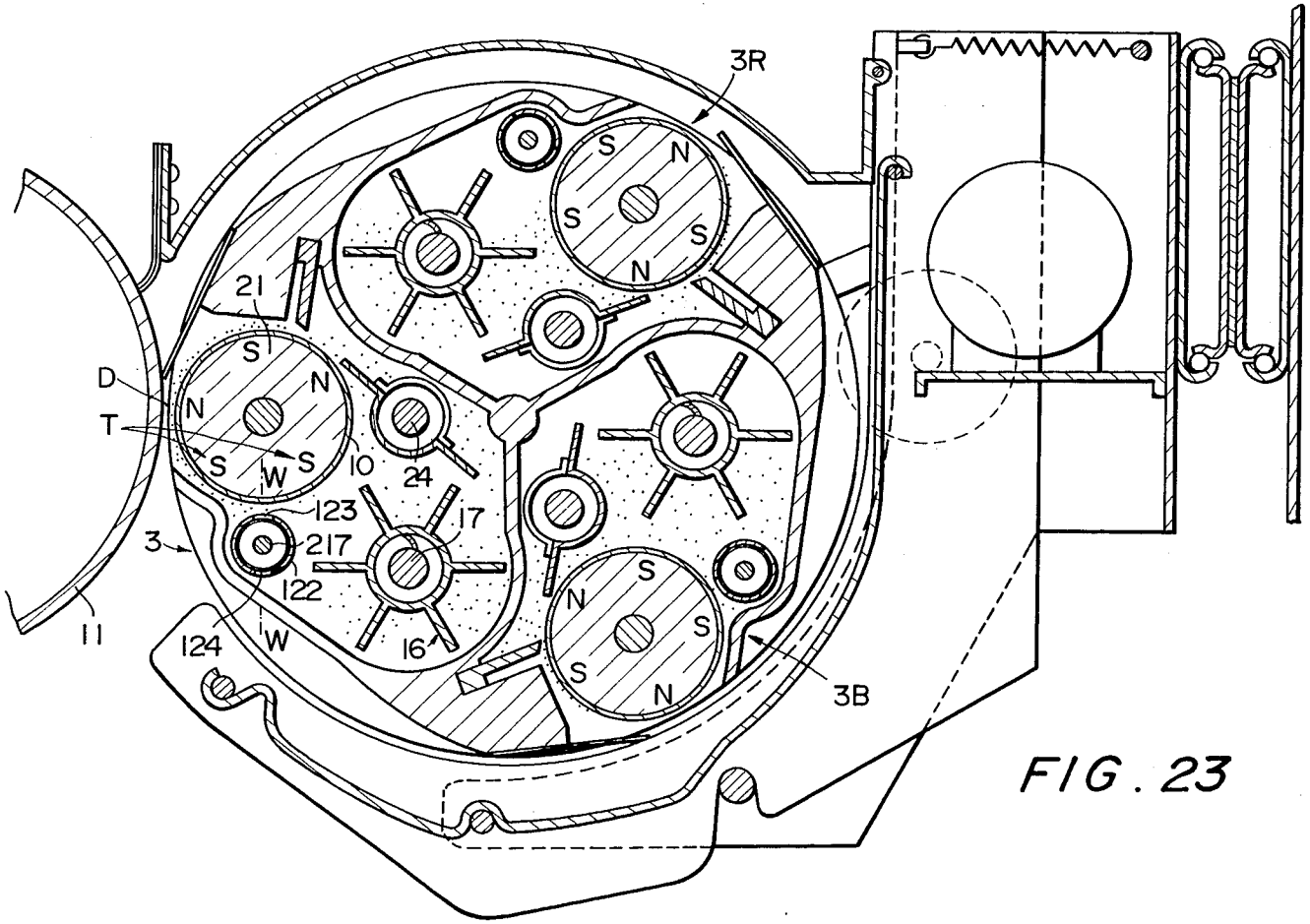
FIG. 23 is a section of a developing unit in accordance with another embodiment of the present invention.

Referring to FIG. 23, another embodiment of the present invention is shown. As shown, a transport screw shaft 217 adapted to transport toner from the toner tank of the toner supply device to the developer chamber 4 is disposed in a non-magnetic toner supply conduit 122 which extends in parallel to the developing roller 10, and not in the bladed wheel 16. Hence, the outer end portion of the conduit 122 is inserted in the toner tank 51 in exactly the same manner as the conduit 20 of FIG. 2. As in the previous embodiment, the developer transported by the screw shaft 24 out of the developer chamber 4 is further fed by the screw shaft 17 within the bladed wheel 16 to the developer chamber 4 or to the outside of the developing section as switched by the path selecting means. However, in this particular embodiment, no developer is conveyed by the screw shaft 17 from the toner tank 51 to the developer chamber 4.

Figure 24:
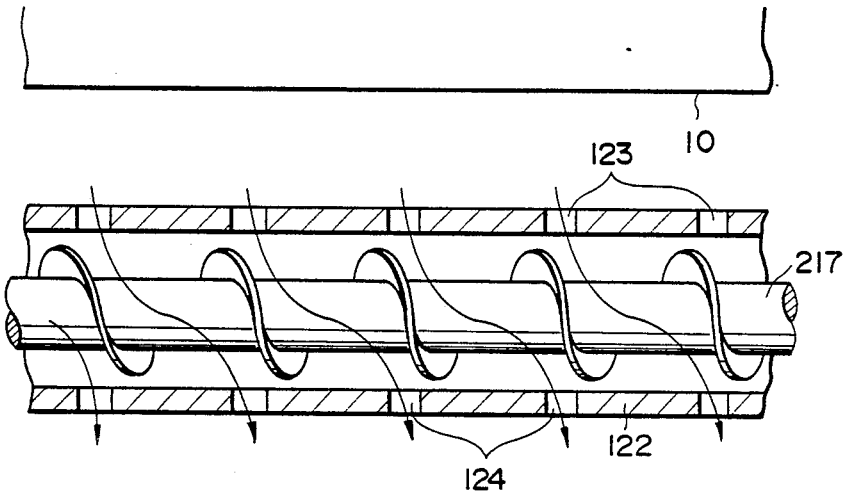
FIG. 24 is a section along line W—W of FIG. 23.

While additional toner is fed through the toner supply conduit 122 into the developer chamber 4 as stated above, its fluidity is poor, compared to that of carrier. Hence should toner alone be caused to flow through the conduit 122 by the rotation of the screw shaft 217, the transporting efficiency would become low. In the light of this, as shown in FIGS. 23 and 24, a number of apertures 123 are formed through an upper portion of the toner supply conduit 122 and arranged along the length of the conduit 122. The developer in the developer chamber 4 is inroduced into the conduit 122 through those apertures 123 and, then, mixed and agitated by the screw shaft 217 with toner which is fed from the toner tank. Because the developer introduced so contains carrier that part of the developer which is agitated in the conduit 122 and contains the additional toner gains greater fluidity and, therefore, flows the conduit 122 smoothly. Thereafter, the developer is discharged to the outside of the conduit 122 through other numerous apertues 124 which are formed through a lower portion of the conduit 122 and also arranged along the length of the conduit 122, thereby being fed to the developer chamber 4.

In the construction shown in FIGS. 23 and 24 as well as that shown in FIG. 1, the magnet 21 disposed in the developing roller 10 is magnetized such that two poles of the same polarity (in the figures, S) neighbor each other in that portion T of the magnet 21 which is located downstream of the developing station D with respect to the direction of rotation of the roller 10. Hence, the developer reached the position T by way of the station D is separated from the surface of the roller 10 by the repulsion acting between those nearby poles and, then, positively introduced into the toner supply conduit 122 through the apertures 123. Further, because the developer removed from the developing roller 10 is low in density, i. e. , it contains little toner and much carrier, feeding it into the toner supply conduit 122 is effective to increase the carrier concentration and, therefore, to enhance the fluidity of the developer. Stated another way, the toner is effectively supplied to and agitated together with the low-density developer which is removed from the developing roller 10. The developer coming out of the conduit 122 is agitated and dispersed by the bladed wheel 16. To promote such dispersion of the developer, a wire, not shown, may be helically wound round the blades of the wheel 16 so as to feed the developer in a direction perpendicular to the sheet surface of FIG. 1.

While the means for removing the developer from the developing roller 10 has been shown and described to comprise two nearby magnetic poles of the same polarity, it may alternatively be implemented with a separator which per ce is well known in the art. In such an alternative case, too, the inlet apertures 123 of the toner supply conduit 122 may be located to face the separating position T to achieve the same effect.

The transport screw shaft 217 disposed in the toner supply conduit 122 may be partly or entirely made of a magnetic material. In this configuration, the shaft 217 would be magnetized by the magnet 21 to positively attract the developer toward it, thereby increasing the amount of developer to be fed into the toner supply conduit 122. This also contributes to the enhancement of fluidity of the developer in the conduit 122. Because the above effect is attainable simply by disposing the magnetic transport screw shaft 217 within reach of the magnetic force of the magnet 21, the conduit 122 may be simply located in a suitable magnetic field other than the one which is established below the position T.

While the construction relating to FIG. 20 as described above is true with the other developing sections 3R and 3B, it is also applicable to a developing device having a single developing section.

No doubt, the present invention is applicable to a rotary developing device in which the developing sections are each installed in a unit configuration, and rotary developing devices of image-forming machines other than a copier.

As stated above, the present invention has various advantages as enumerated below.

(1) At least one of opposite end walls of a developing unit which delimit developer chambers of discrete developing sections is provided with generally cylindrical outer periphery, and this outer periphery is supported at at least two points by fragmentary support members. This allows the developing unit to be surely supported in a rotatable manner even if the a developing device and its associated various elements are positioned outward of the end walls. Further, because it is the end walls of the developing unit which is supported by support members, the need for extra members to be supported is eliminated to cut down the cost of the developing unit as well as the overall dimensions of the developing device.

(2) A developing unit can be moved into and out of the body of an image-forming apparatus without interfering with an image carrier. Because a cradle for holding the developing unit and/or the center of rotation of the developing unit are positioned relative to the apparatus body, the rotation of the developing unit is not obstructed at all.

(3) A means is provided for moving a support member, which is mounted on the body of an image-forming apparatus to support the end wall of the developing unit, away from the developing unit when the latter is to be moved in and out and moving it into abutment against that end wall when the developed unit is loaded in its predetermined position. Hence, the developing unit can be mounted and dismounted without being obstructed by the support member.

(4) Because at least one of support members which are adapted to support the end walls of the developing unit is retained by a movable member, that support member does not interfere with the movement of the developing unit into and out of the body of an image-forming apparatus. In addition, that support member is movable away from the end wall of the developing unit to facilitate mounting and dismounting of the unit.

(5) When the developing unit is pulled out from a predetermined position in the body of an image-forming apparatus together with a cradle, the developing unit remains rotatably supported by the cradle. This facilitates the access to any desired part of the developing unit for any particular work.

Various modifications will become possible for those skilled in the art after receiving the teachings of the present disclosure without departing from the scope thereof.

What is claimed is:

1. A rotary developing device for an image-forming apparatus, comprising:

a developing unit having at least a developing section for developing an electrostatic latent image formed on an image carrier which is supported by a body of said image-forming apparatus; and a unit carrier for supporting said developing unit and slidably supported by said body;

when said developing unit is pulled out together with said unit carrier from a predetermined position which is defined in said apparatus body, said developing unit remaining rotatably supported by said unit carrier.

2. A rotary developing device for an image-forming apparatus, comprising:

a developing unit having at least one developing section in which a developer chamber storing a developer is defined, and rotatably supported while facing an image carrier of said image-forming apparatus;

two opposite end walls defining opposite ends of said developer chamber of said developing section, outer periphery of at least one of said end walls being provided with a cylindrical configuration; and a support means for supporting said outer periphery rotatably at least at two points of said outer periphery.

3. A rotary developing device for an image-forming apparatus, comprising:

a developing unit rotatably supported at a predetermined position where said developing unit faces an image carrier of said image-forming apparatus;

a unit carrier for supporting said developing unit and slidably supported by a body of said image-forming apparatus, said unit carrier comprising a slider slidably supported by said body, a cradle supported by said slider to be movable toward and away from said image carrier, and a biasing means for biasing said cradle away from said image carrier together with said developing unit; and a positioning guide means for, when said developing unit is loaded in a predetermined position relative to said image carrier inside of said body, positioning at least one of said cradle and a center of rotation of said developing unit against a force of said biasing means to thereby retain said developing unit in said predetermined position and, when said unit carrier is slid relative to said apparatus body, freeing said developing unit and said cradle from restraint to cause said cradle to be brought to a position remote from said image carrier together with said developing unit by said biasing means.

4. A rotary developing apparatus for an image-forming apparatus, comprising:

a developing unit having a developer chamber therein, rotatably supported at a predetermined position where said developing unit faces an image carrier of said image-forming apparatus, and manually movable out of the predetermined position;

a unit carrier for supporting said developing unit such that, when said developing unit is pulled out of the predetermined position, said developing unit is removable from said unit carrier;

at least one of opposite end walls which define opposite ends of said developer chamber of said developing unit being provided with a cylindrical configuration;

three support means for, when said developing unit is loaded in the predetermined position, supporting outer periphery of said at least one end wall rotatably at at least three points; and a movable member mounted on said unit carrier for causing at least one of said support means to be supported movably away from said end wall when said developing unit pulled out is removed from said unit carrier, whereby said at least one support means is prevented from interfering with movement of said developing unit out of said unit carrier.

5. A rotary developing device for an image-forming apparatus, comprising:

a developing unit having a developer chamber therein, rotatably supported at a predetermined position where said developing unit faces an image carrier of said image-forming apparatus, and manually movable out of the predetermined position;

a unit carrier for supporting said developing unit such that, when said developing unit is pulled out of the predetermined position, said developing unit is removable from said unit carrier;

at least one of opposite end walls which define opposite ends of said developer chamber of said developing unit being provided with a cylindrical configuration;

three support means for, when said developing unit is loaded in the predetermined position, supporting outer periphery of said at least one end wall rotatably at at least three points, at least one of said support means being mounted on a body of said image-forming apparatus; and a means for, when said developing unit is moved out of and into the predetermined position, moving said at least one support means mounted on said body away from said developing unit and, when said developing unit is loaded in the predetermined position, moving said support means mounted on said apparatus body into abutment against said end wall of said developing unit.

* * * * *